US005295936A

United States Patent [19]

Perry, Jr.

[11] Patent Number: 5,295,936

[45] Date of Patent: Mar. 22, 1994

[54] ADDUCTOR CONTRACTION EXERCISE APPARATUS AND METHOD

[76] Inventor: Leroy R. Perry, Jr., 1301 East Rubio St., Altadena, Calif. 91101

[21] Appl. No.: 898,842

[22] Filed: Jun. 15, 1992

Related U.S. Application Data

[63] Continuation-in-part of Ser. No. 706,648, Jun. 3, 1991, Pat. No. 5,135,459.

[51] Int. Cl.[5] ..... A63B 23/04

[52] U.S. Cl. ..... 482/144; 482/142; 482/134

[58] Field of Search ..... 482/142, 144, 145, 907, 482/148, 908, 95; 128/25 R, 70, 68, 57; 273/188 R, 273

[56] References Cited

U.S. PATENT DOCUMENTS

| | | | |
|---|---|---|---|
| 418,257 | 12/1889 | Whitely . | |
| 623,698 | 4/1899 | Beckh . | |
| 1,693,810 | 12/1928 | Daniels et al. . | |
| 2,046,653 | 7/1936 | Petcoff . | |
| 2,498,006 | 2/1950 | Ridill . | |
| 3,618,942 | 11/1971 | Bates . | |
| 3,652,085 | 3/1972 | Cole . | |
| 3,677,543 | 7/1972 | Richardson . | |
| 3,685,511 | 8/1972 | Alvarez . | |
| 3,722,507 | 3/1973 | Krause . | |
| 3,807,730 | 4/1974 | Dalton et al. . | |
| 3,857,561 | 12/1974 | Cecchettini et al. | 482/142 |
| 3,870,317 | 3/1975 | Wilson . | |
| 4,019,734 | 4/1977 | Lee et al. . | |
| 4,207,879 | 6/1980 | Safadago et al. . | |
| 4,247,096 | 1/1981 | Schmitt . | |
| 4,292,962 | 10/1981 | Krause . | |
| 4,304,401 | 12/1981 | Goodman . | |
| 4,328,964 | 5/1982 | Walls . | |
| 4,340,218 | 7/1982 | Wilkinson . | |
| 4,411,423 | 10/1983 | Estwanik, III . | |
| 4,461,287 | 7/1984 | Takahashi . | |
| 4,494,533 | 1/1985 | Sgroi et al. . | |
| 4,503,845 | 3/1985 | Licciardi . | |
| 4,534,555 | 8/1985 | McGowen . | |
| 4,544,155 | 10/1985 | Wallenbrock et al. . | |
| 4,566,693 | 1/1986 | Seidentop et al. . | |
| 4,609,193 | 9/1986 | Paris et al. . | |
| 4,703,929 | 11/1987 | Reed . | |
| 4,753,438 | 6/1988 | Paris et al. . | |
| 4,884,804 | 12/1989 | Fenwick . | |
| 4,893,813 | 1/1990 | Murray et al. . | |
| 5,002,043 | 3/1991 | George . | |

*Primary Examiner*—Richard J. Apley
*Assistant Examiner*—Jerome Donnelly
*Attorney, Agent, or Firm*—William W. Haefliger

[57] ABSTRACT

An exercise apparatus, comprising a support structure; a platform mounted on the support structure to support a user's legs, and to allow pivoting of the user's trunk about a generally horizontal axis as the user relatively bends his body and his legs; and other structure associated with the platform to induce contraction of the user's thighs relatively toward one another in response to the trunk pivoting, for producing anterior rotation of the user's ilium, thereby inducing distraction of the user's sacroiliac joint, at the ilium posterior; the other means including a thigh grippable element projecting into an inter-thigh region of the user's legs, to be clamped between the user's thighs.

9 Claims, 20 Drawing Sheets 2
3
3
37
36
30
38
30a
20
22
45
44
25
31
28
18
24
33
32
15
12
52
58
58
56
52
10
16
13
2

20
33
34
32

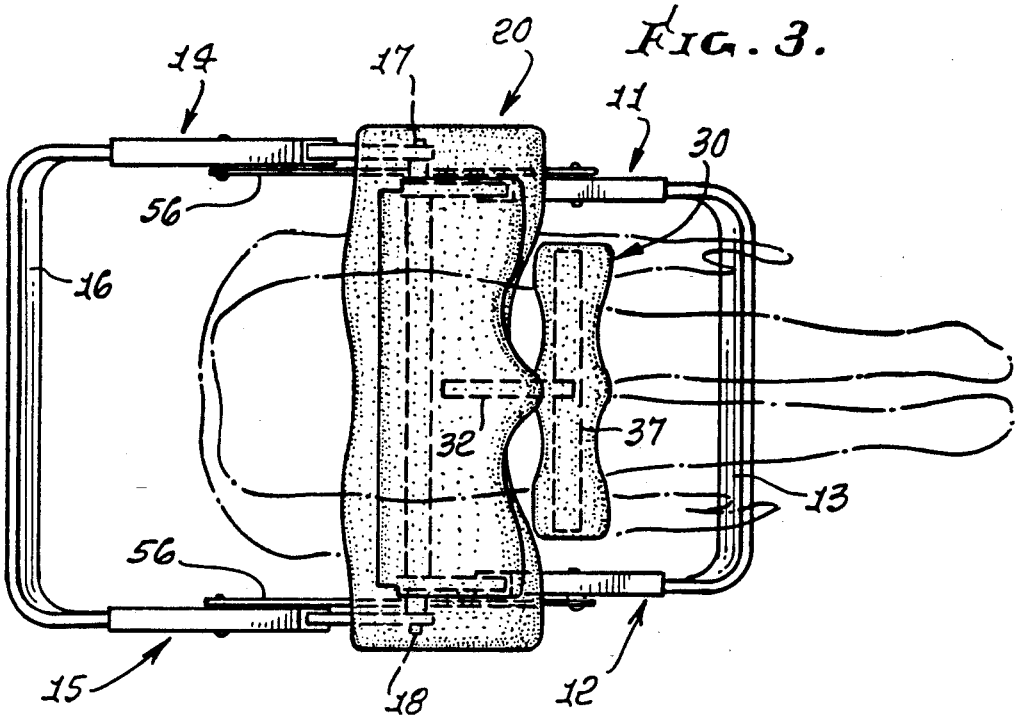
FIG. 3.
FIG. 20a.
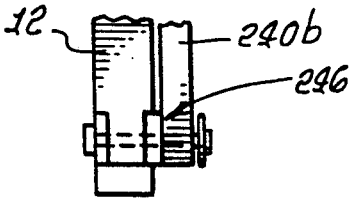
FIG. 20.
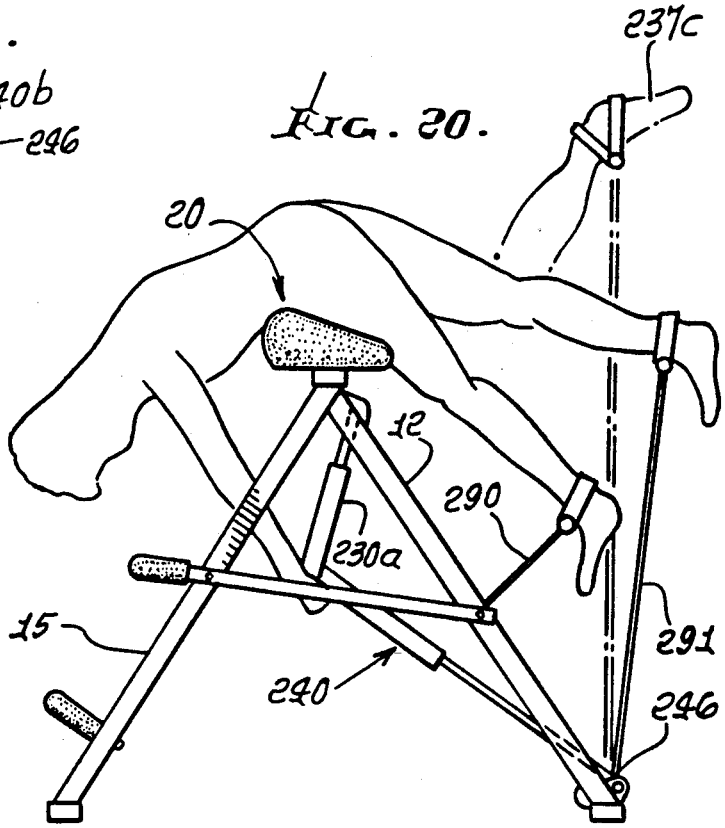

FIG. 28.
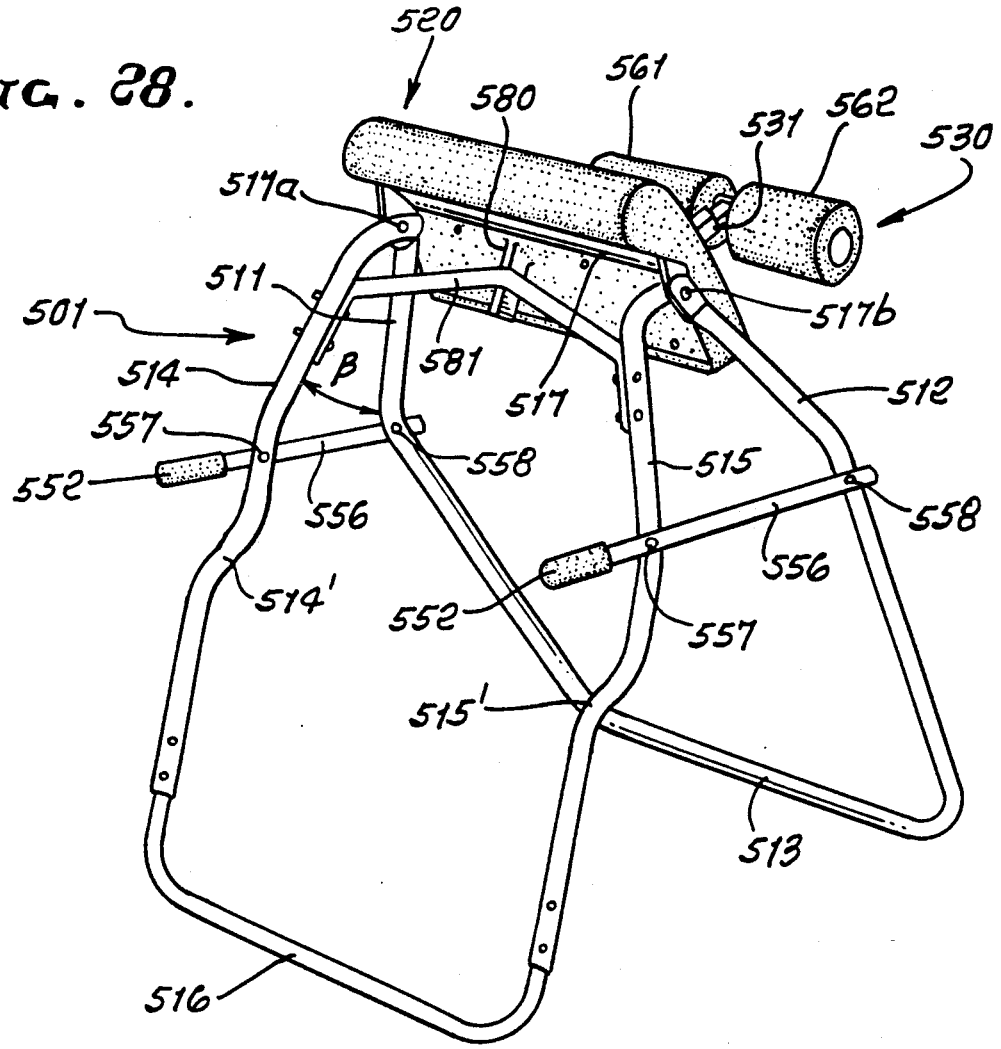
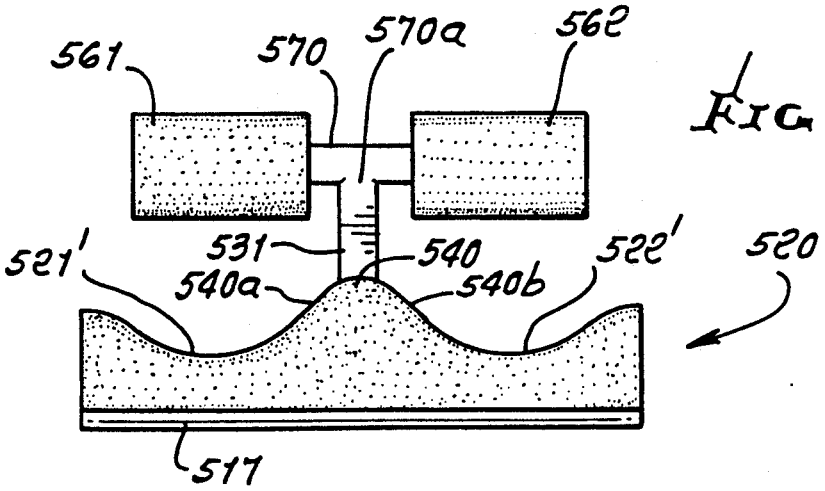
FIG. 32.

ADDUCTOR CONTRACTION EXERCISE APPARATUS AND METHOD

This application is a second continuation-in-part of Ser. No. 706,648 filed Jun. 3, 1991, now U.S. Pat. No. 5135459.

BACKGROUND OF THE INVENTION

This invention relates generally to body exercise apparatus, and more particularly to improved apparatus providing for adductor contraction during relative bending, extending or flexing of the user's trunk and legs.

Many people suffer from internal organ weakness, inner pelvic muscular and ligament laxity, inner thigh and adductor, gracilis muscular weakness, weak abdominal musculature, spinal and lower back, and instability resulting from loss of symmetry of muscle development. There is need for apparatus providing a means whereby those who suffer from the aforementioned can exercise biomechanically efficiently to strengthen the necessary muscle groups to ensure a strong, symmetrical development of the body with emphasis on adductor (inner thigh) and abdominal stability.

SUMMARY OF THE INVENTION

It is a major object of the invention to provide apparatus or equipment that is operable or usable in such manner as to meet the above need. Basically, the apparatus serves to distract or distend the user's spine to relieve pressure as at the sacroiliac region, in response to forward flexing of the user's trunk relative to his or her legs. In this regard, the apparatus aids in inducing adductor contraction (inner thigh contraction), which approximates the anterior aspect of the ilium while decreasing load on the sacroiliac joints posteriority. This procedure is accomplished by use of a medial inner thigh pad that ensures adductor contraction or inner thigh grip of the protruding pad, as the body and legs relatively flex. Such biomechanical action reduces sacroiliac compression, while maximizing reduction of stress on the lumbosacral joints. Adductor contraction also stimulates lower abdominal muscle contraction, thereby emphasizing inner pelvic muscular contraction and strengthening, which is accomplished through isokinetic exercise movement associated with the adductor contractions and inverted flexion movements. This controlled, biomechanical movement not only stretches the hamstring, gluteus maximus, erector spinal and associated posterior body musculature while decompressing the spine, but also strengthens the adductor, gracilis, abdominal, and inner pelvic musculature.

Those who suffer from tipped uteruses and bladders, prostate dysfunction or related diseases, or pathomechanical syndromes related to muscular instability and therefore internal organ pressure or compression in a vertical posture, as well as those patients with lower abdominal vascular, muscular, and neurological compression, can often benefit from exercise that produces a combined action of forward flexion and adductor contraction.

In some cases, stretching of the abdominal viscera may be helpful. In those cases, extension and even hyperextension may be accomplished with adductor contraction, thereby emphasizing the inner thigh, groin, pelvic wall, and entire abdominal cavity.

The apparatus of the invention can be used to accomplish a horizontal supine position and varying degrees of load and difficulty by altering the height of support platform swinging depending upon the needs of the patient for muscular contraction and work load required while emphasizing adductor contraction. An adjustable frame is provided and allows for height and load variability, from 0 degrees to 45 degrees, therefore creating quadriceps and iliopsoas stretch, as well as adductor and rectus abdominal contraction. With rotational movement of the patient through multiple and varying degrees of rotation, abdominal, adductor and associated internal pelvic musculature can be strengthened. Means associated with the platform or seat induces contraction of the user's thighs relatively toward one another in response to the trunk pivoting, for producing anterior rotation of the user's ilium, thereby inducing distraction of the user's sacroiliac joint, at the ilium posterior. The seat apparatus can also be angularly adjusted in order to vary the angle of the foreleg, thigh, hip, pelvic, and spinal musculature, thereby increasing or decreasing work load, isokinetic contraction, and resistance. These techniques are beneficial to those suffering from the aforementioned maladies and are believed unique as respects multiple angles and contour formation of the novel apparatus. A crosspiece associated with the platform also contributes to induced contraction of the user's legs toward one another.

The apparatus may also have telescopic legs to vary the height both for prone or supine positions, allowing for changes in angles of biomechanical stress throughout the body. The invention is also designed for portability and collapses so it can be carried in a single travel bag.

Yet another object is to provide exercise apparatus that includes:

a) a support means, b) a platform mounted on the support means to support a user's legs, and to allow pivoting of the user's trunk about a generally horizontal axis as the user relatively bends his body and his legs, c) and other means associated with the platform to induce contraction of the user's thighs relatively toward one another in response to trunk pivoting, for producing anterior rotation of the user's ilium, thereby inducing distraction of the user's sacroiliac joint, at the ilium posterior, d) the other means including a thigh grippable element projecting into an inter-thigh region of the user's legs, to be clamped between the user's thighs.

The crosspiece may be pivotally mounted to pivot about a horizontal transverse axis relative to the platform. Auxiliary strut means may be connected to the crosspiece and to the support means at a level below the platform to position the crosspiece relative to the platform; and the auxiliary strut means may include relatively movable members adjustable to control the tilt angle of the crosspiece.

Yet another object is the provision of a crosspiece mounted on the support means and carried for adjustable positioning relative to the platform. Carriage structure may be supported on the support means to carry the crosspiece for adjustable positioning in two dimensions, relative to the platform. Both the platform and crosspiece may have common pivoted support to pivot about the same horizontal axis, relative to the support means. Also, stop means may be provided in association with the support means and with the platform to interrupt or stop pivoting of the platform and crosspiece at a determined tilted condition of the platform.

These and other objects and advantages of the invention, as well as the details of an illustrative embodiment, will be more fully understood from the following specification and drawings, in which:

DRAWING DESCRIPTION

FIG. 1 is a side elevation showing one form of apparatus embodying the invention;

FIG. 1*a* is an enlarged vertical section;

FIG. 3 is a top plan view taken on lines 3—3 of FIG. 1;

Figure 6A:
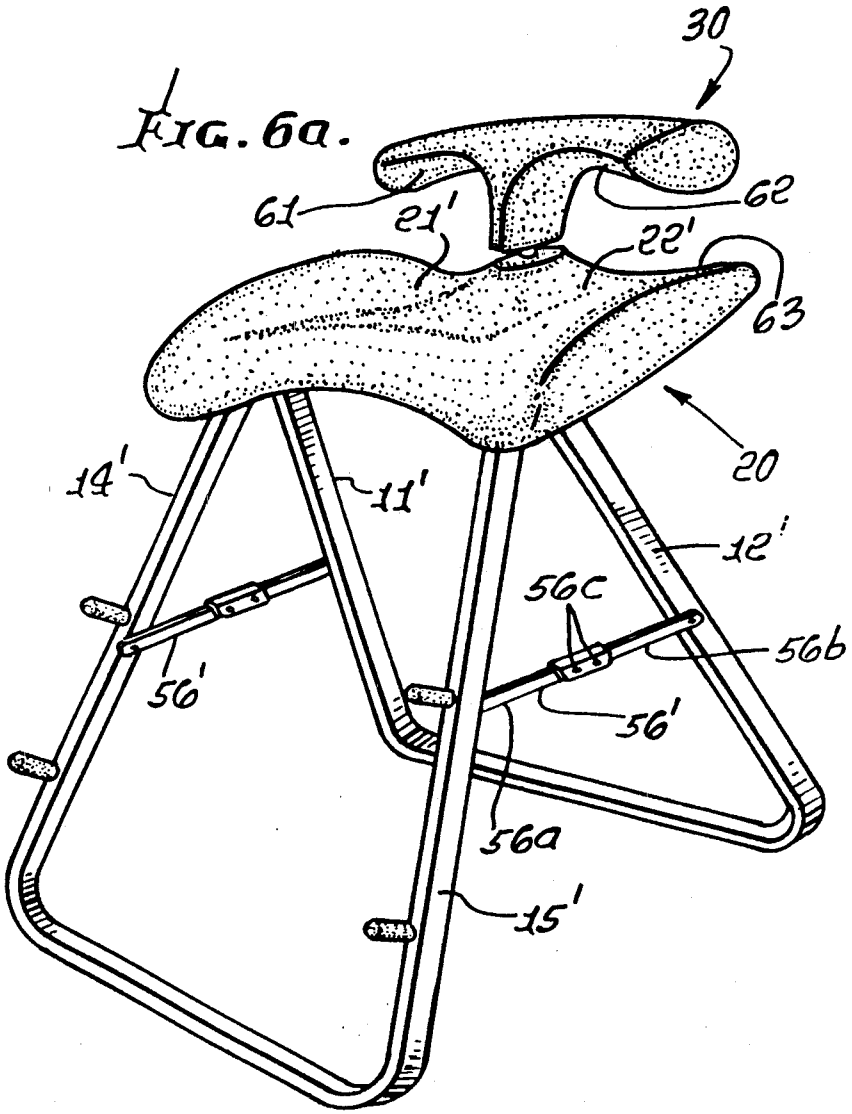
Figure 6:
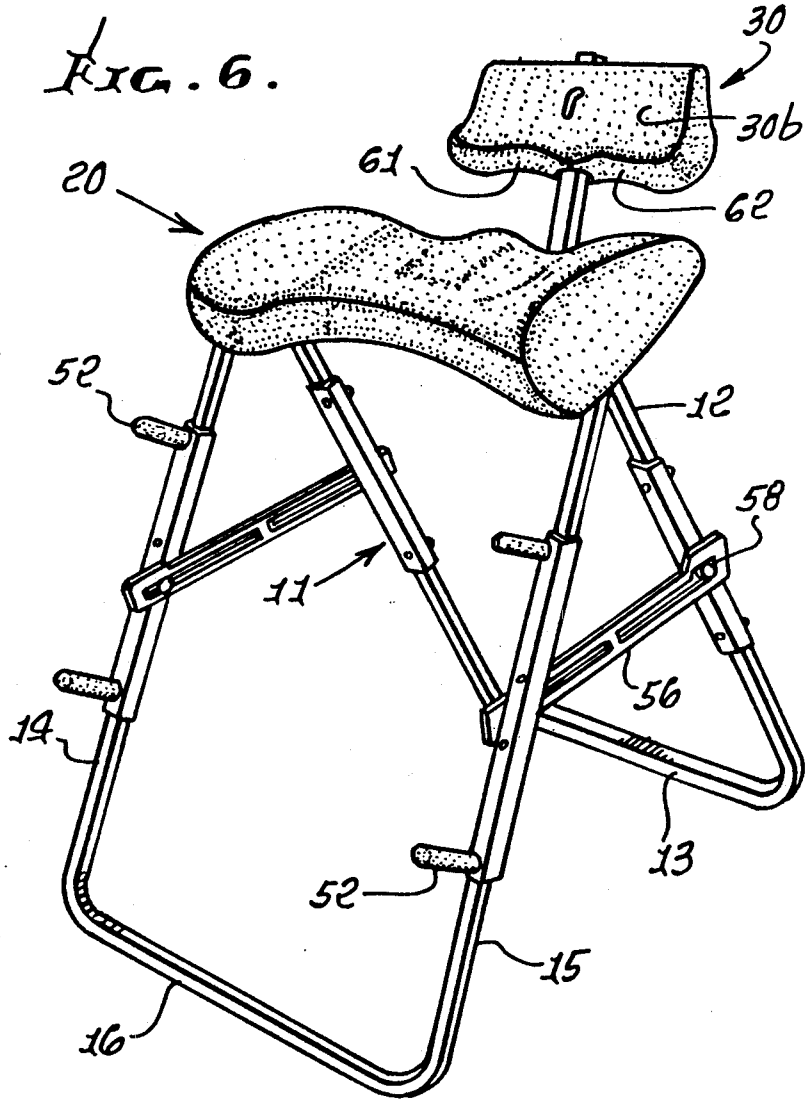
Figure 8:
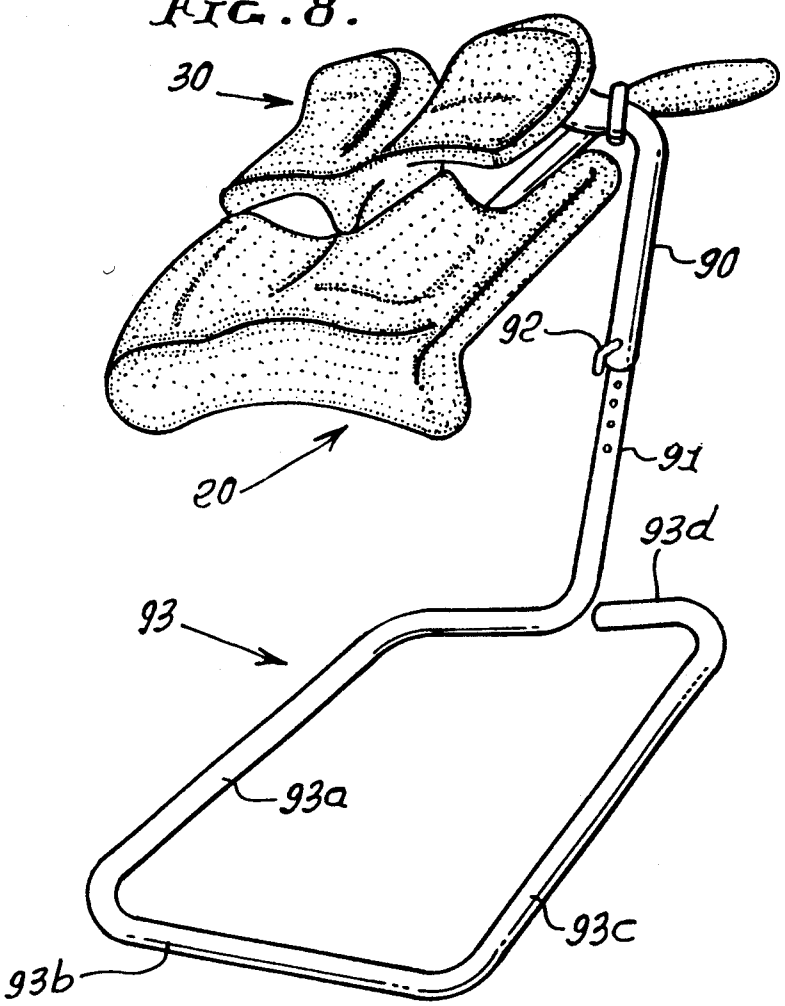
Figure 7:
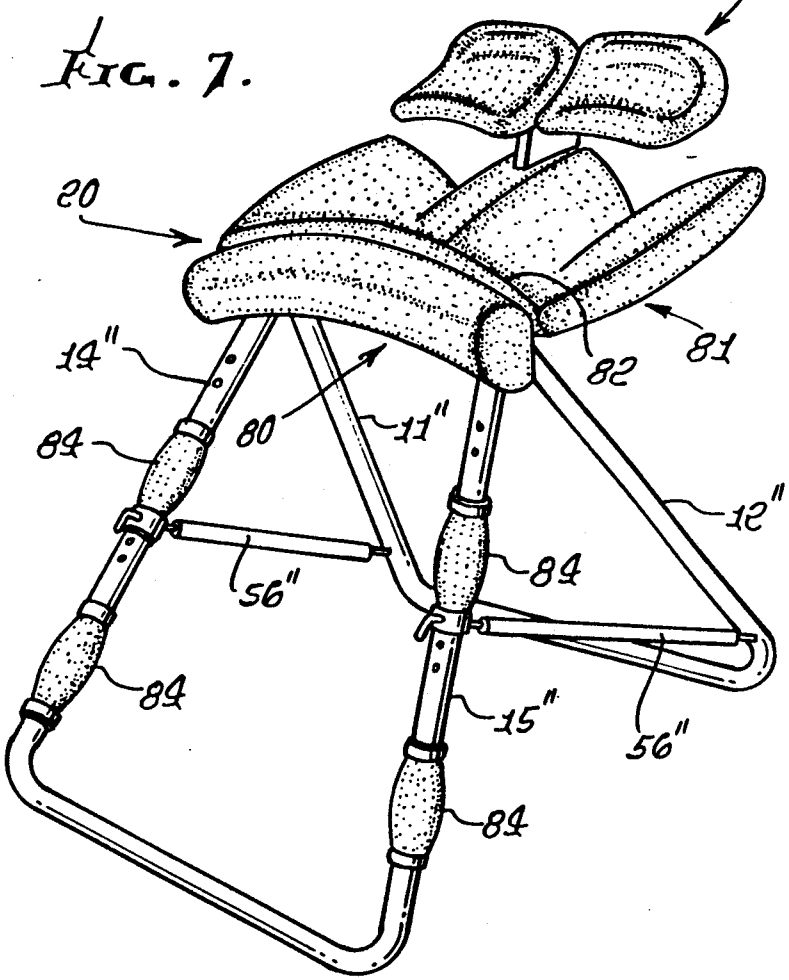
Figure 9:
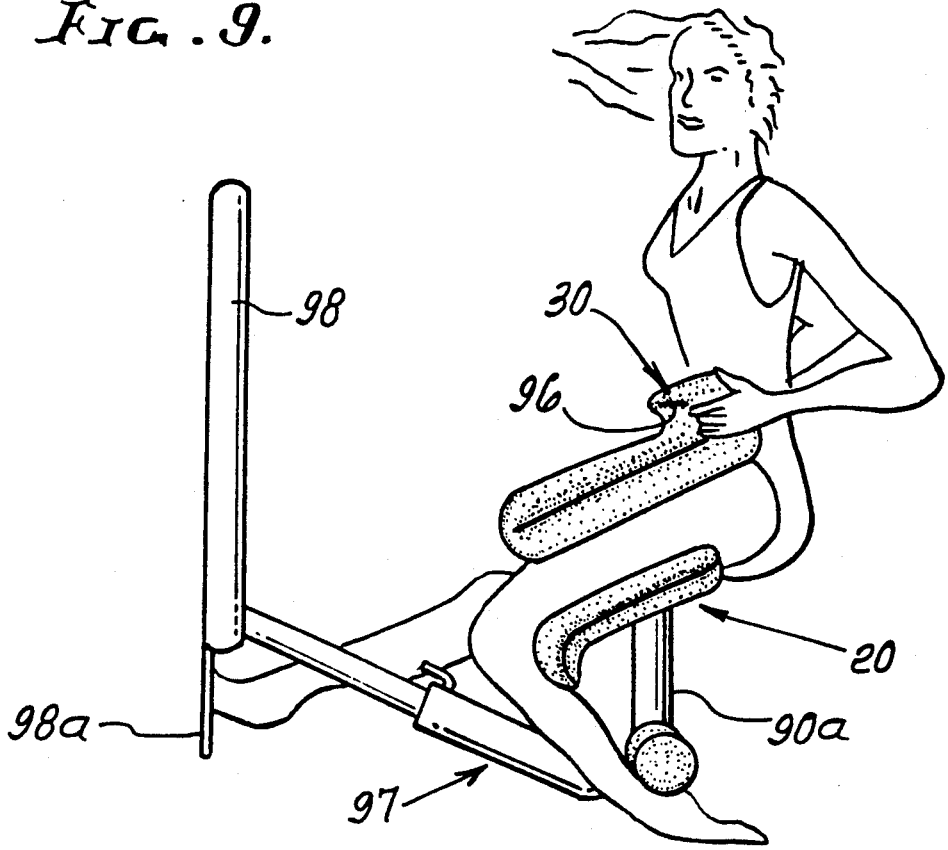
Figure 10:
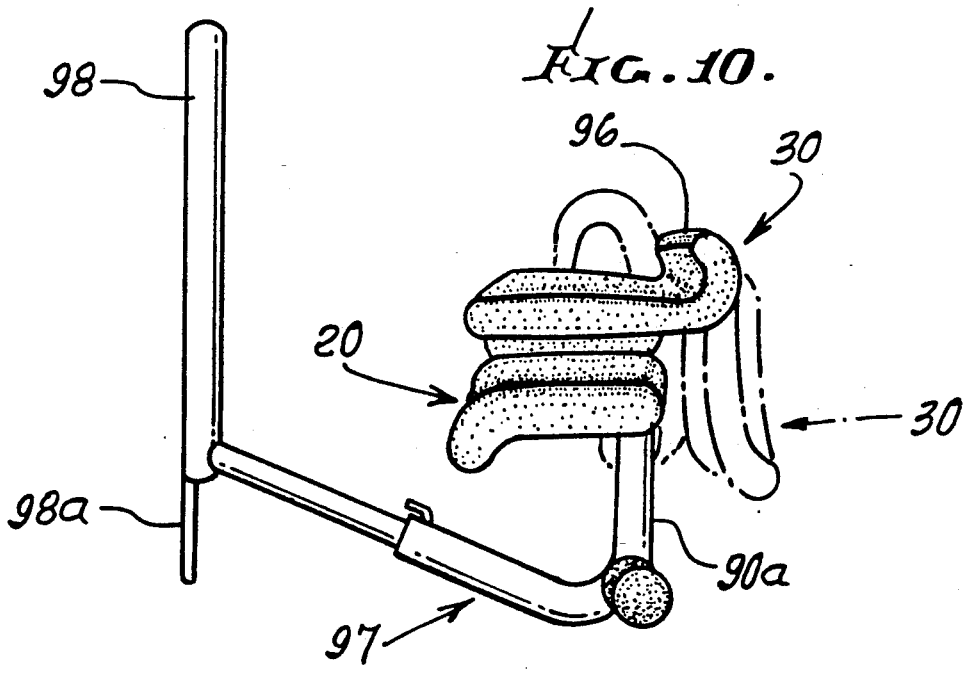
Figure 11A:
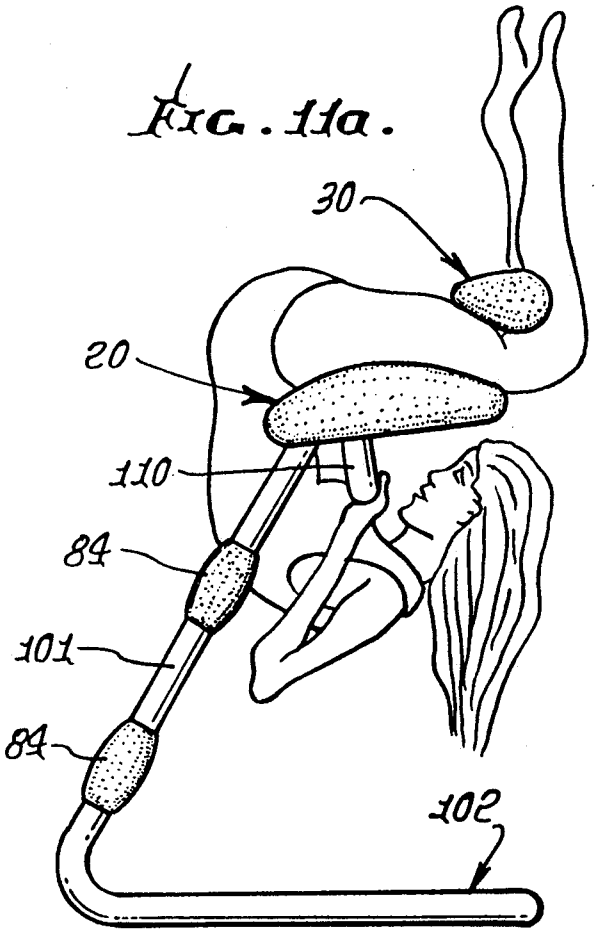
Figure 11:
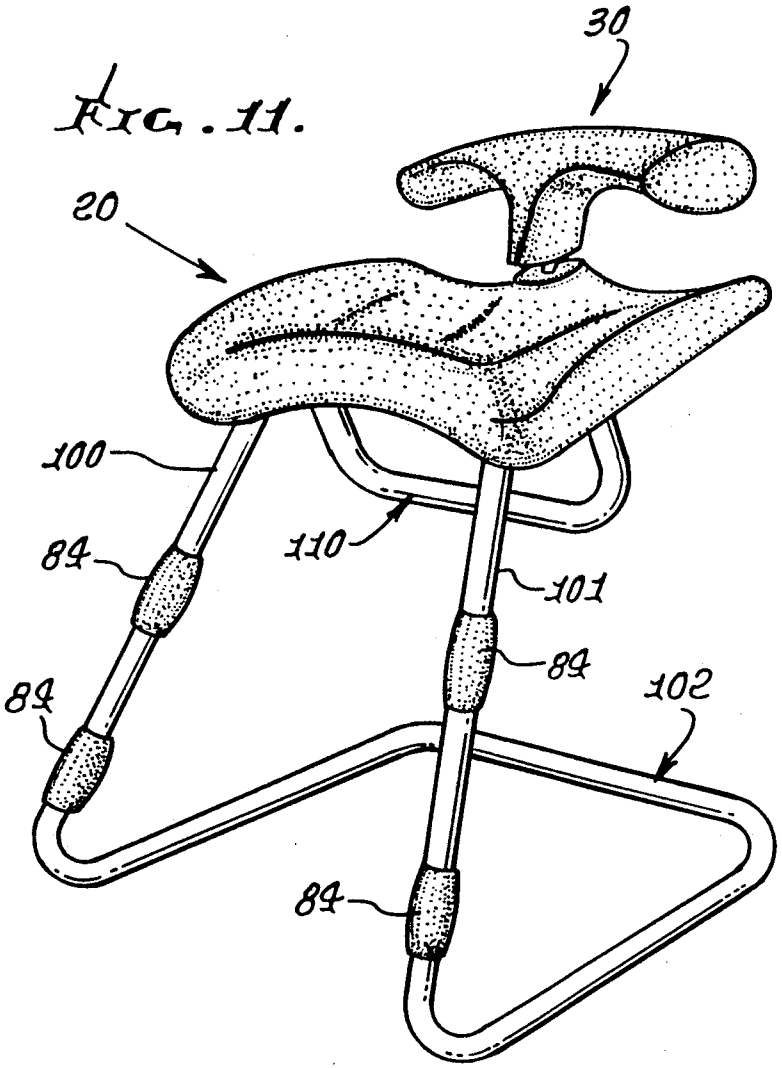
Figure 12:
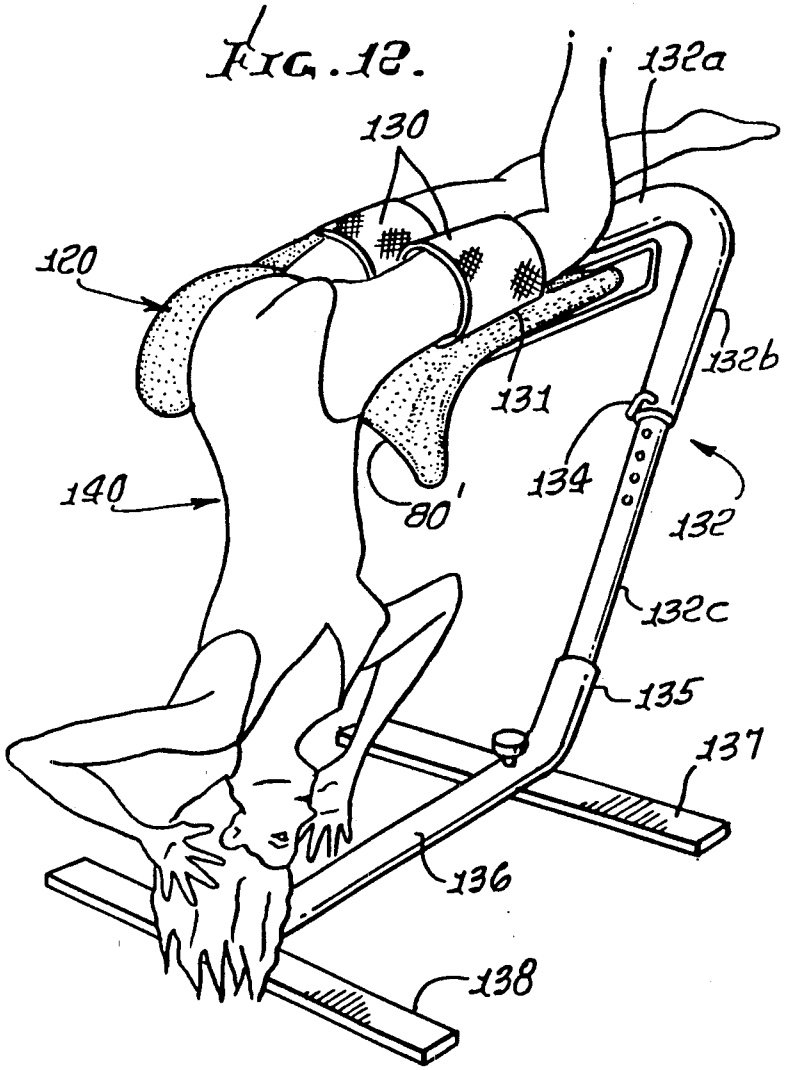
Figure 11B:
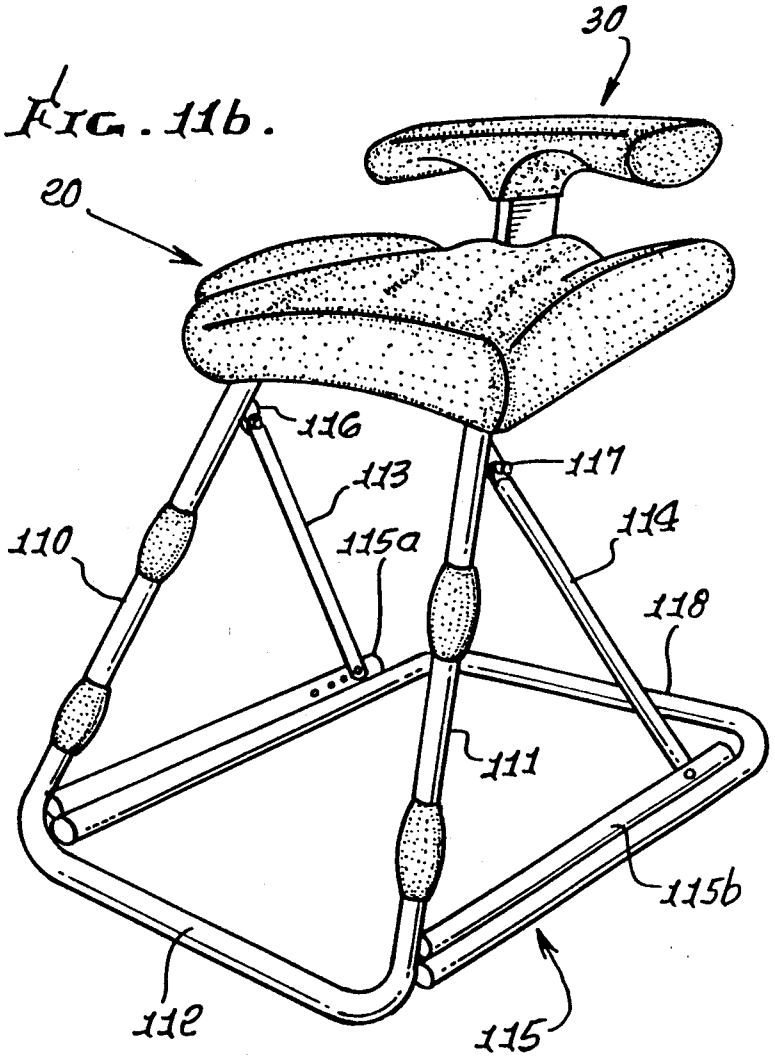
Figure 13A:
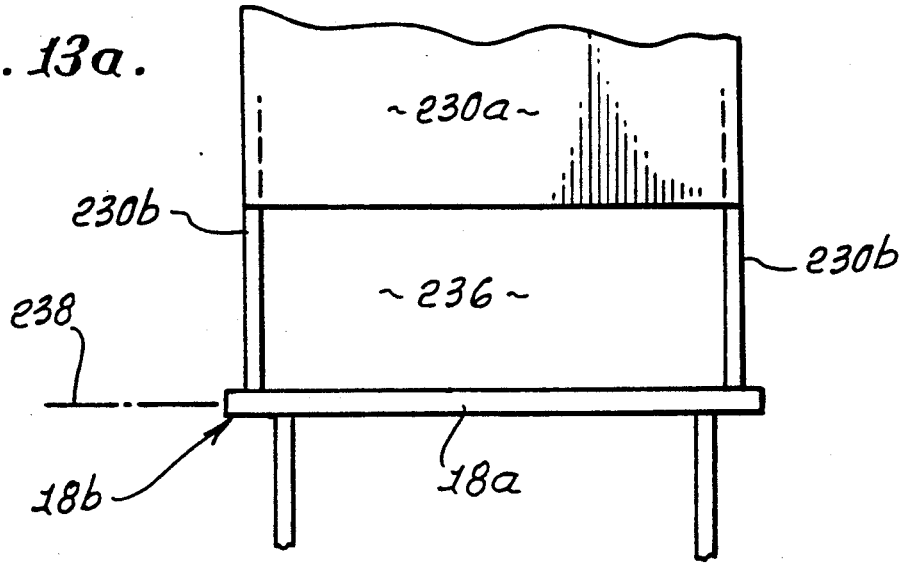
Figure 13:
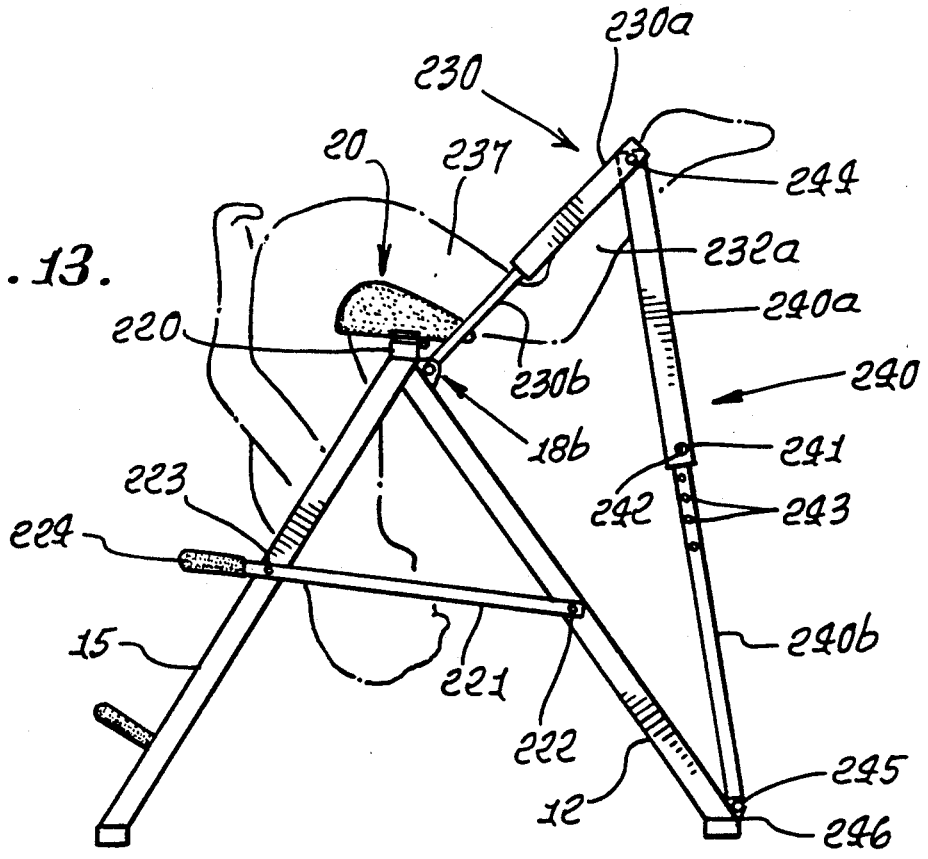

FIGS. 6 and 6*a* are perspective views showing further modified apparatus;

FIG. 7 is a perspective view showing yet another form of the apparatus;

FIG. 8 is a perspective view of modified apparatus having a single leg or post support;

FIGS. 9 and 10 are perspective views of an additional form of apparatus incorporating the invention;

FIGS. 11, 11*a* and 11*b* are perspective views of apparatus having two legged support;

FIG. 12 is a perspective view of further modified apparatus incorporating leg straps;

FIG. 13 is a side view of modified apparatus; and

Figure 14:
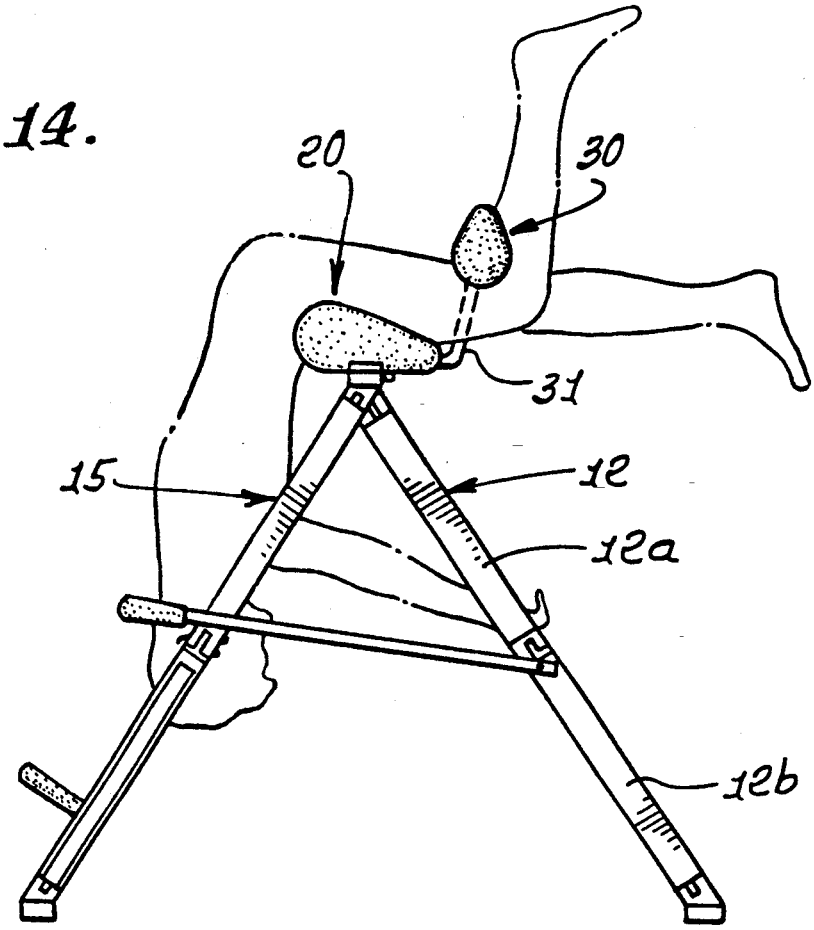

FIG. 13*a* is a fragmentary plan view of a portion of the FIG. 13 apparatus;

FIG. 14 is a side view of modified apparatus; and

Figure 14A:
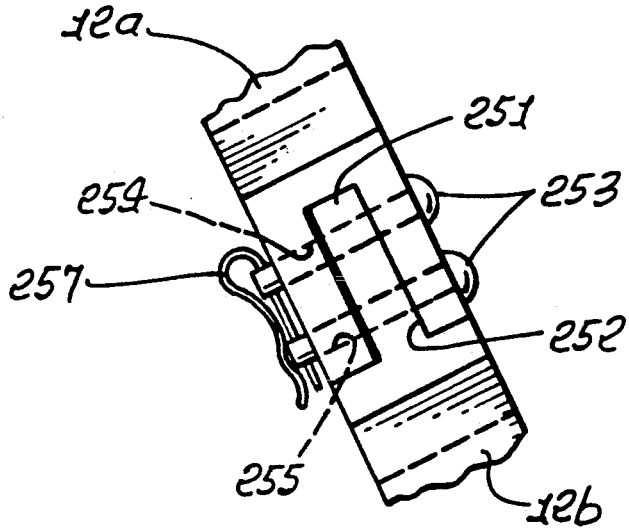
Figure 15:
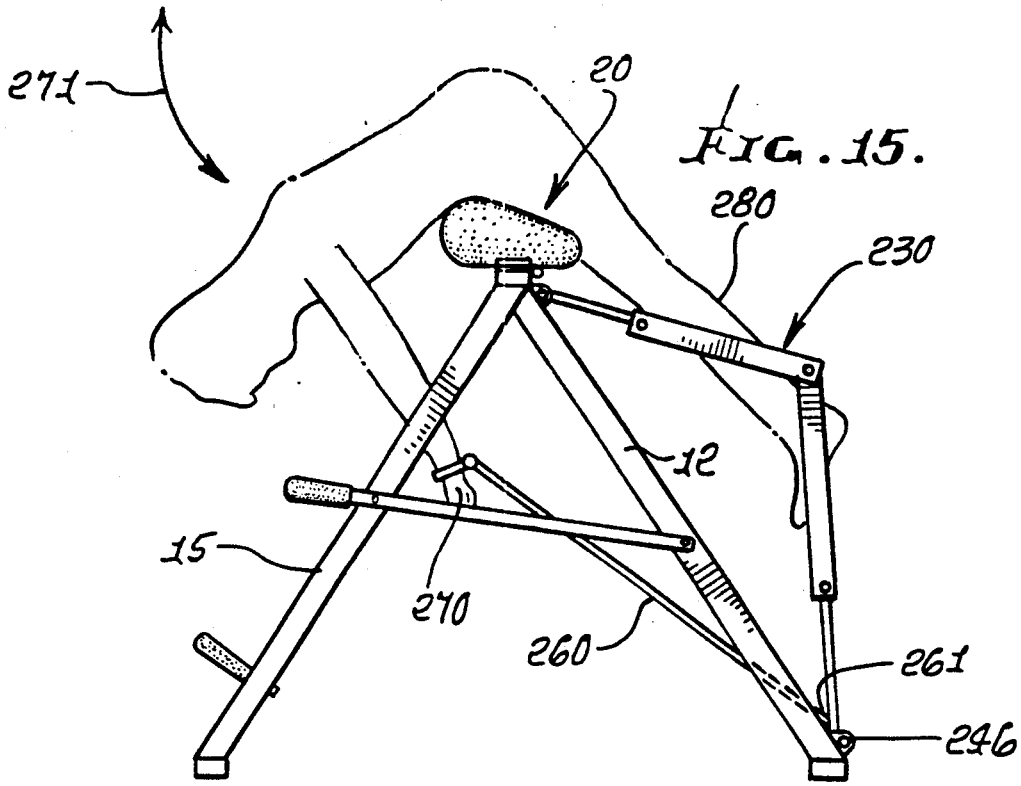
Figure 16:
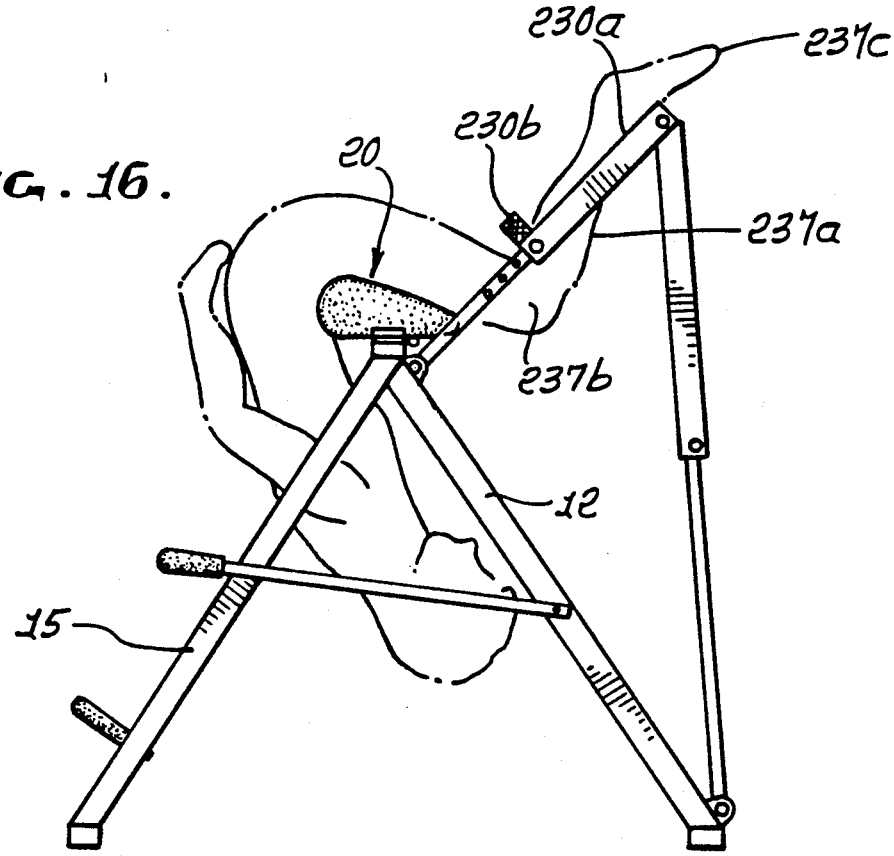
Figure 17:
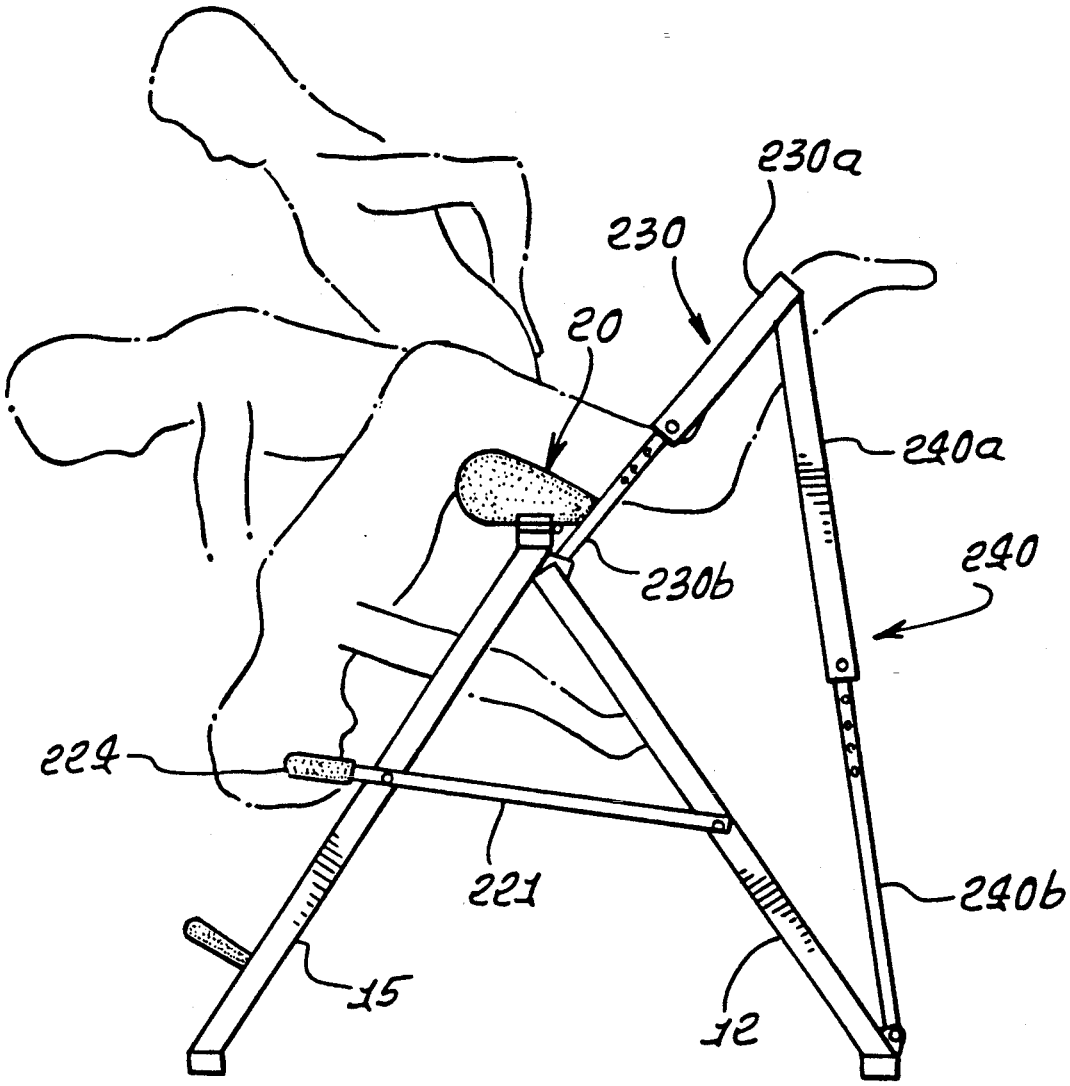
Figure 18:
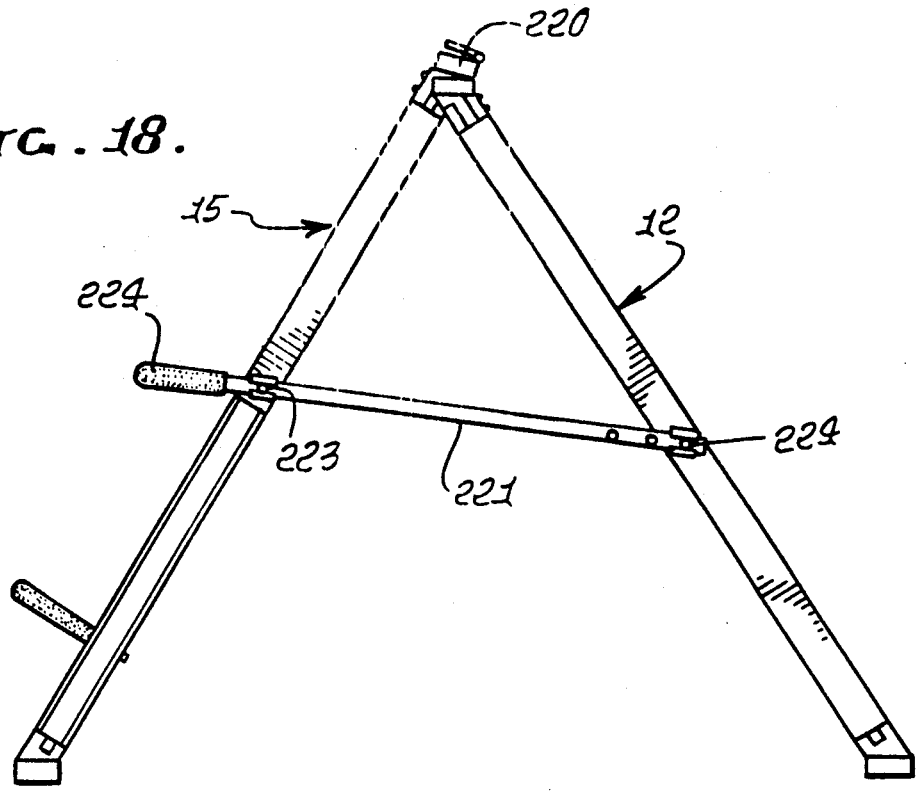
Figure 19:
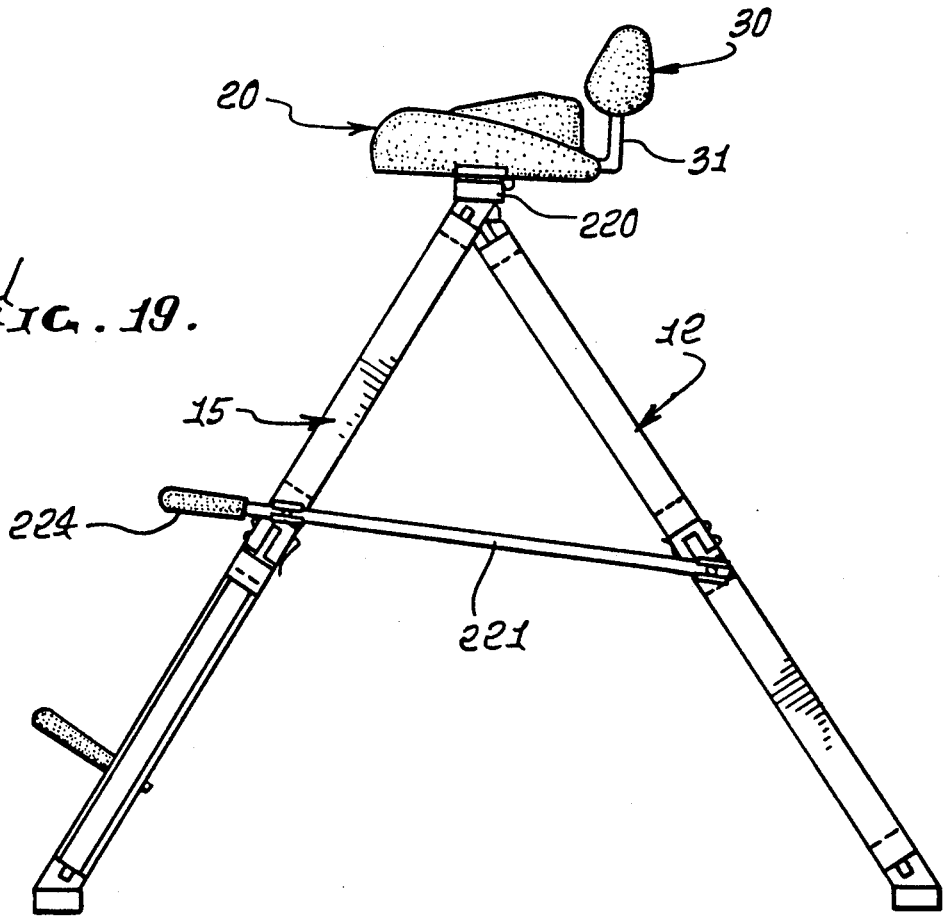
Figure 21:
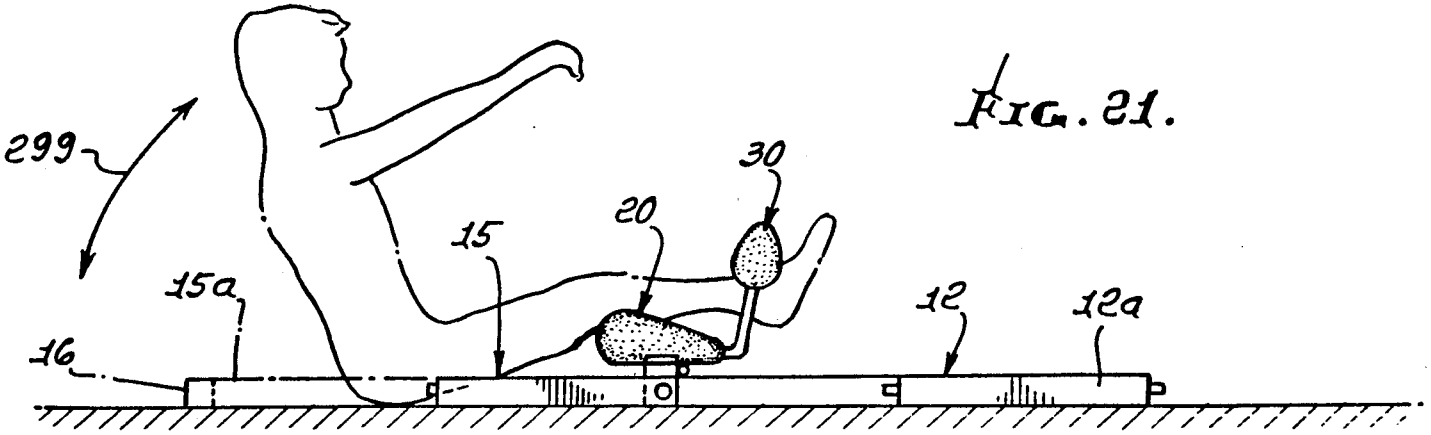
Figure 24:
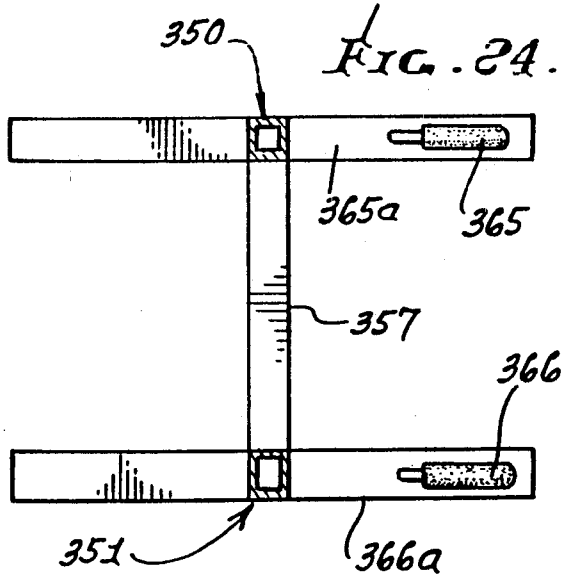
Figure 25:
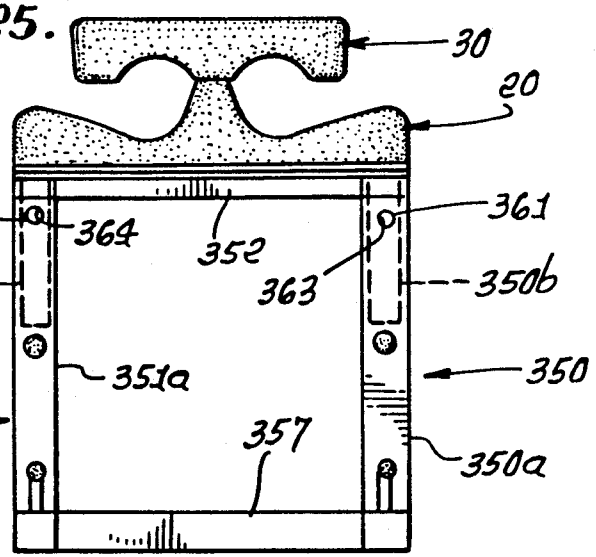
Figure 22:
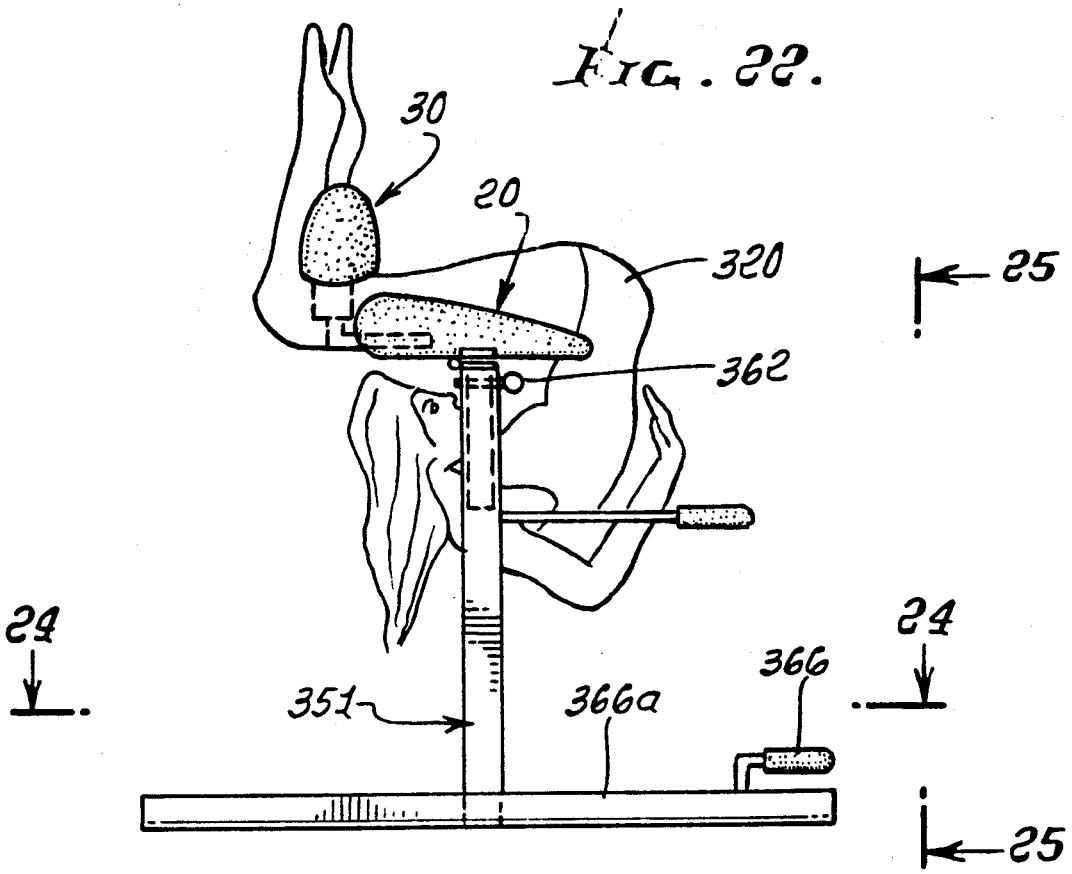
Figure 23:
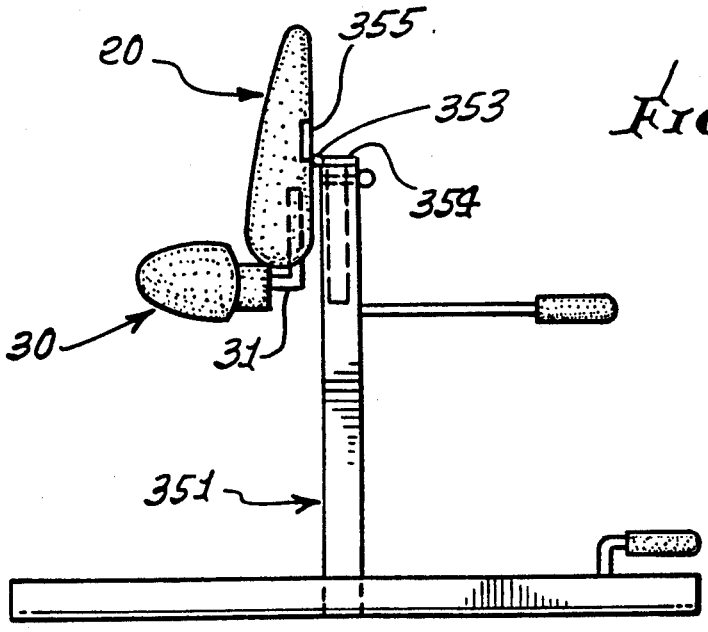

FIG. 14*a* is an enlarged fragmentary view of leg member interconnection means;

FIGS. 15–17 are side elevational views showing further modified apparatus;

FIGS. 18 and 19 are side views showing details of support means and platform structure;

FIG. 20 is a side elevation showing another mode of use of the FIG. 16 apparatus;

FIG. 20*a* is an enlarged fragmentary view showing hinge structure as employed in FIG. 20;

FIG. 21 is an elevation showing another position of the FIG. 14 apparatus;

FIG. 22 is a view like FIG. 14 showing a modification;

FIG. 23 is a view of the FIG. 22 modification showing a hinge connection;

FIG. 24 is a plan view taken on lines 24—24 of FIG. 22;

FIG. 25 is an elevation taken on lines 25—25 of FIG. 22; and

Figure 26:
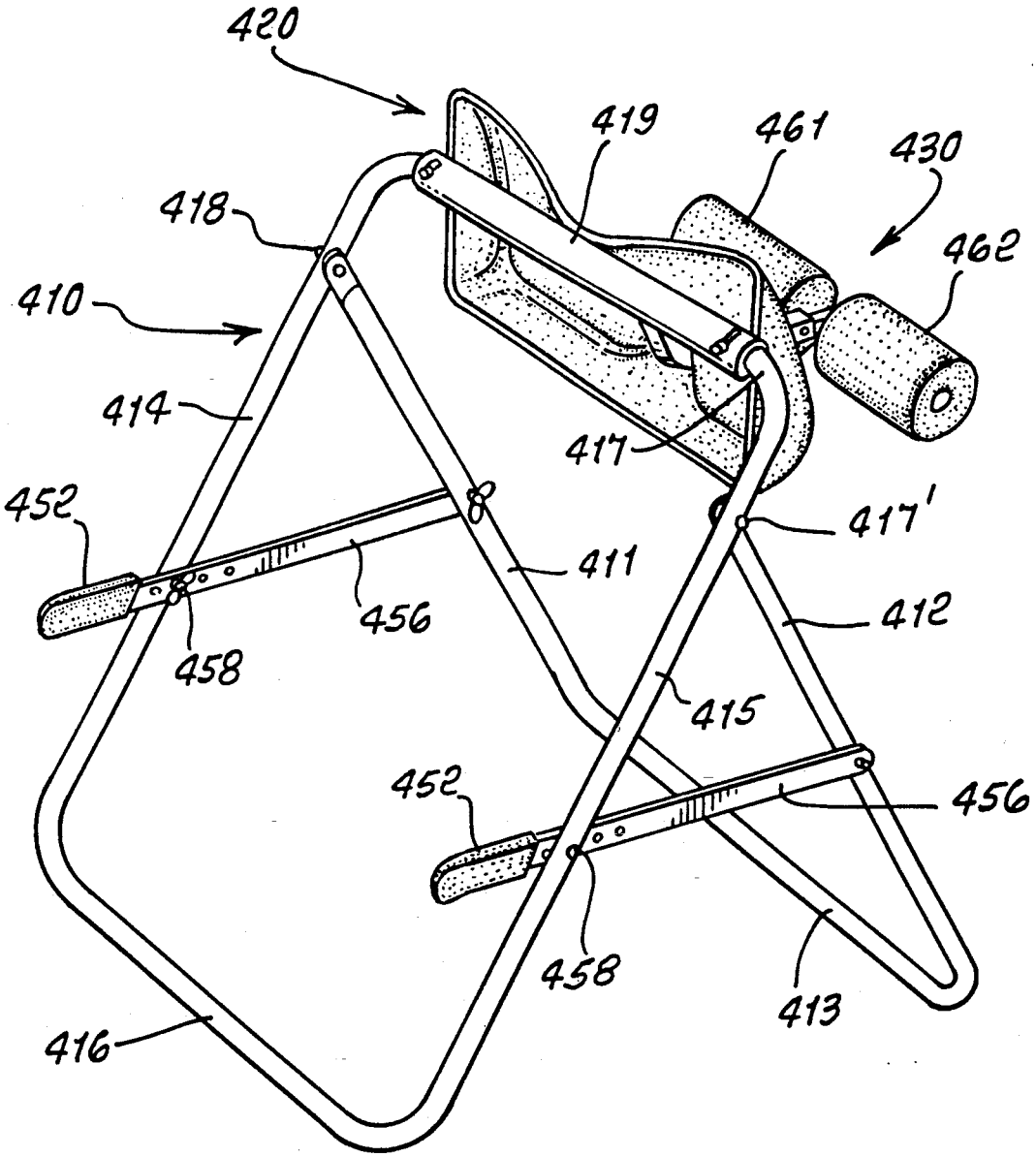
Figure 27:
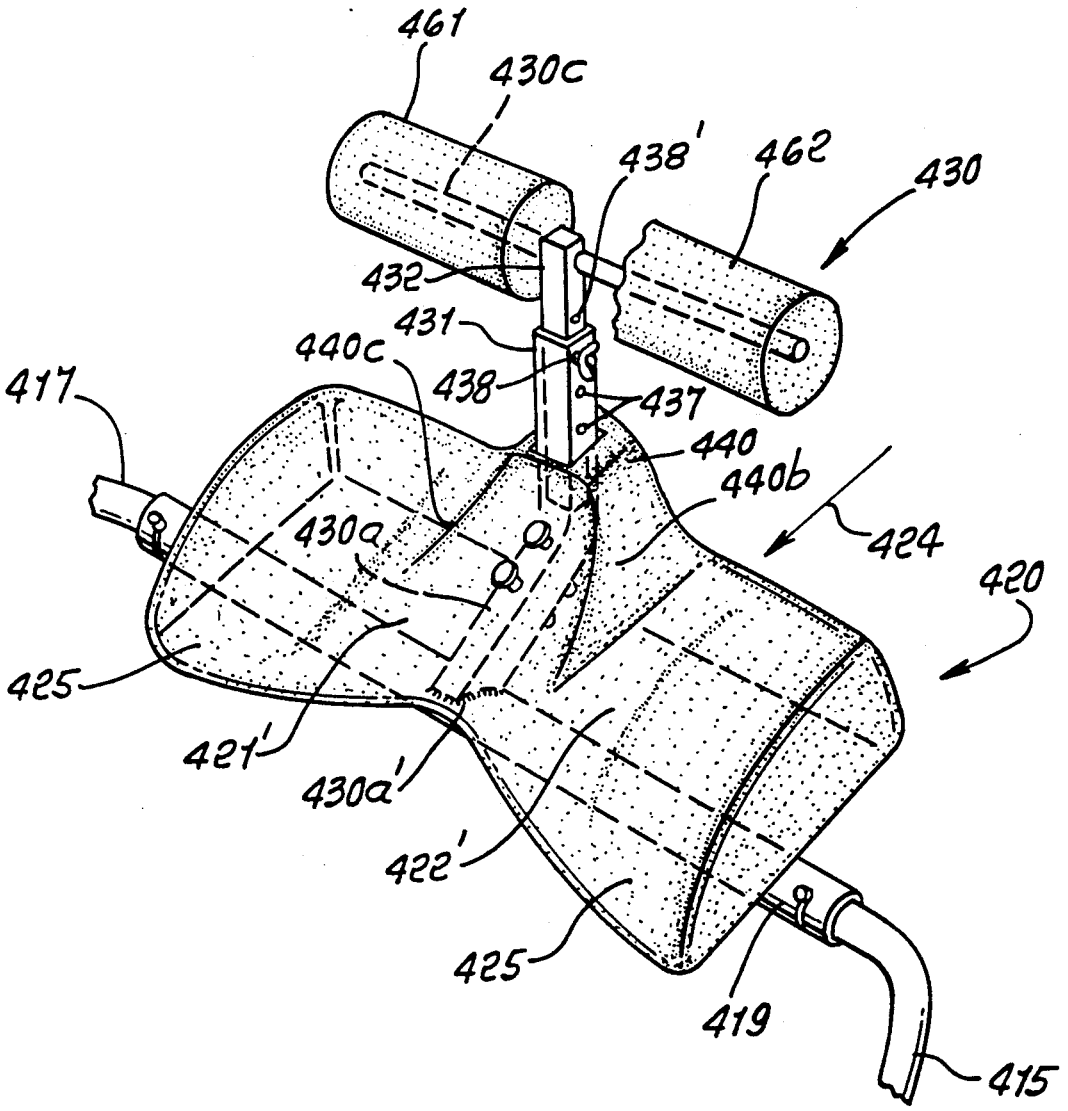
Figure 29:
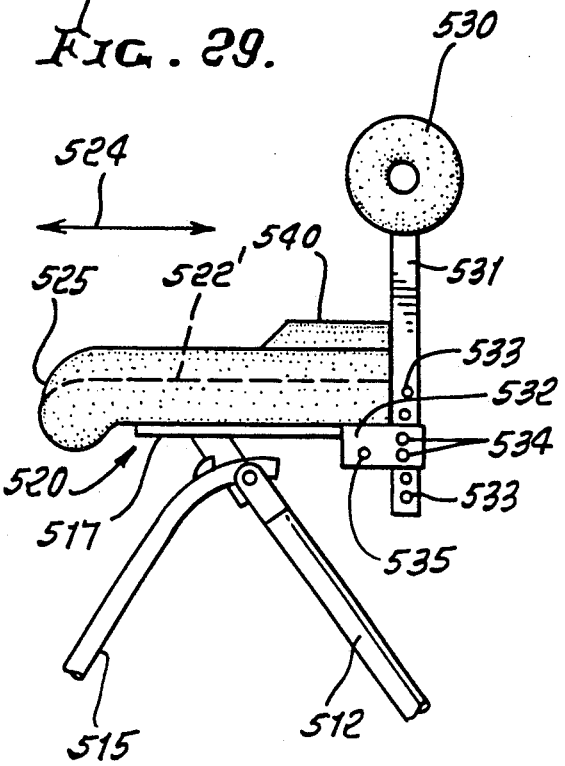
Figure 30:
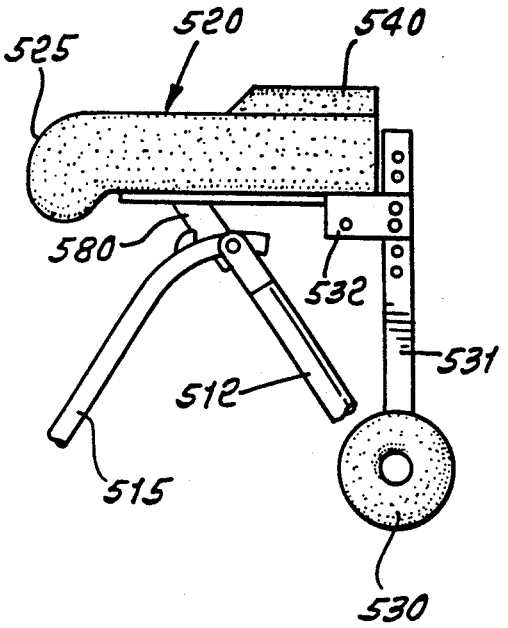
Figure 31:
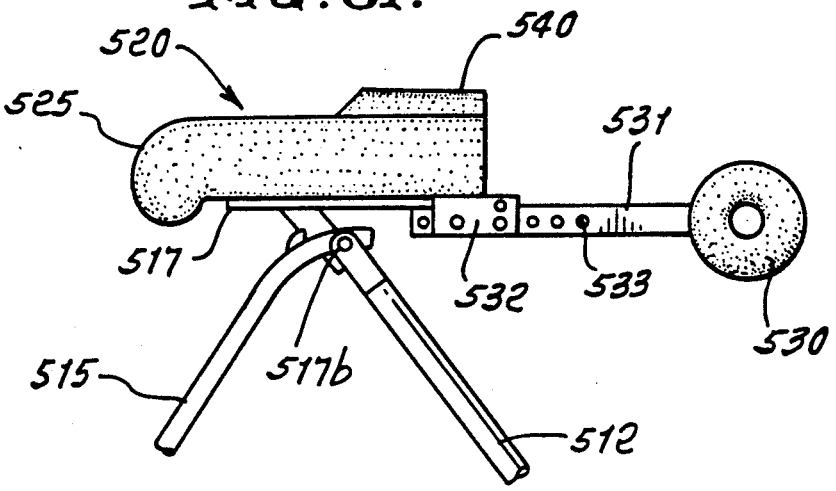

FIG. 26 is a perspective view of a modification;

FIG. 27 is an enlarged perspective view of an adjustable platform and crosspiece employed in the FIG. 26 modification;

FIG. 28 is a perspective view of yet another modification;

FIG. 29 is a fragmentary view of the FIG. 28 "thigh saddle" platform, and second pad, the latter in upright position;

FIG. 30 is a view like FIG. 29 showing the second pad in downwardly extended position;

FIG. 31 is a view like FIG. 29 showing the second pad in rearwardly extended position; and FIG. 32 is a frontal view of the platform and second pad, and taken on lines 32—32 of FIG. 29.

DETAILED DESCRIPTION

Figure 1:
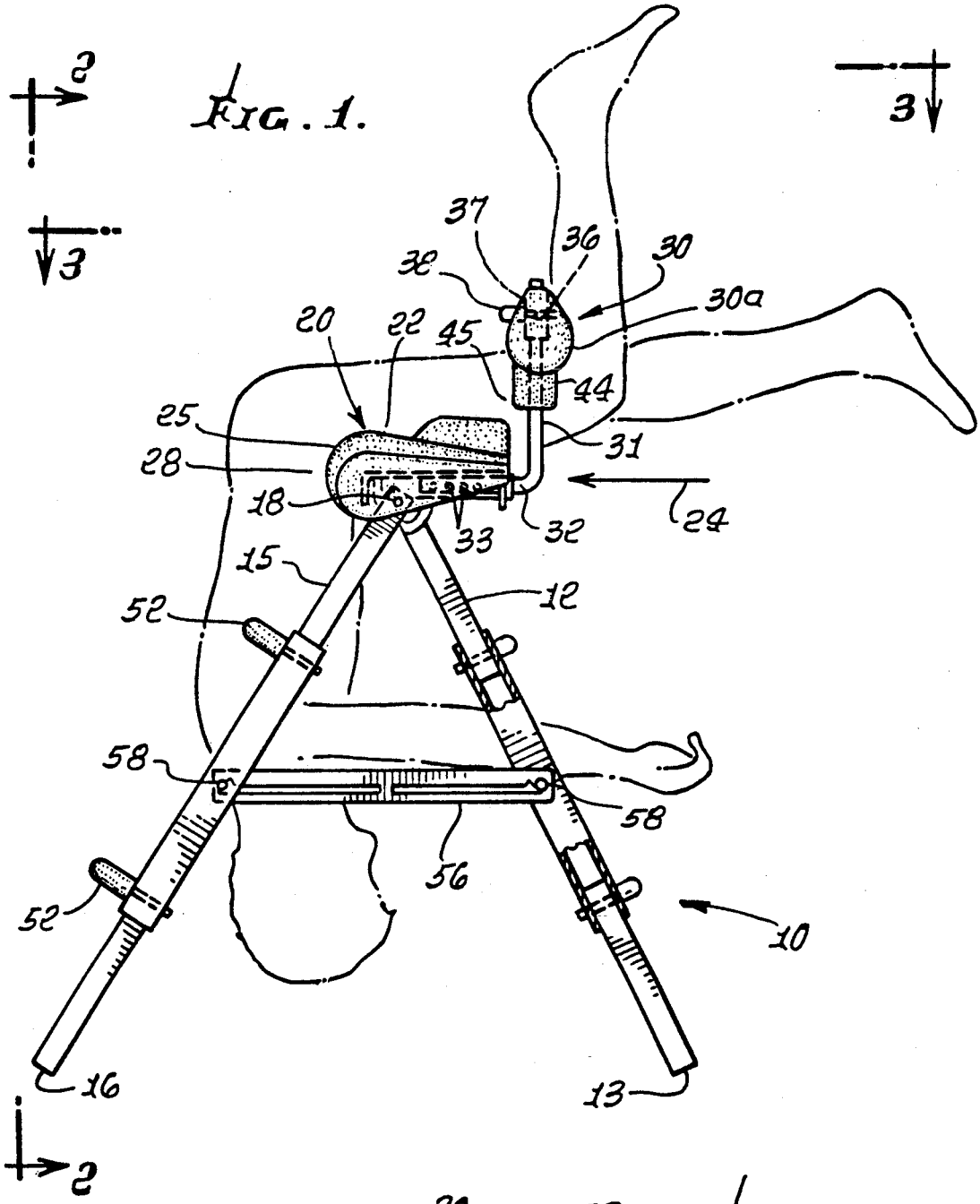
Figure 2:
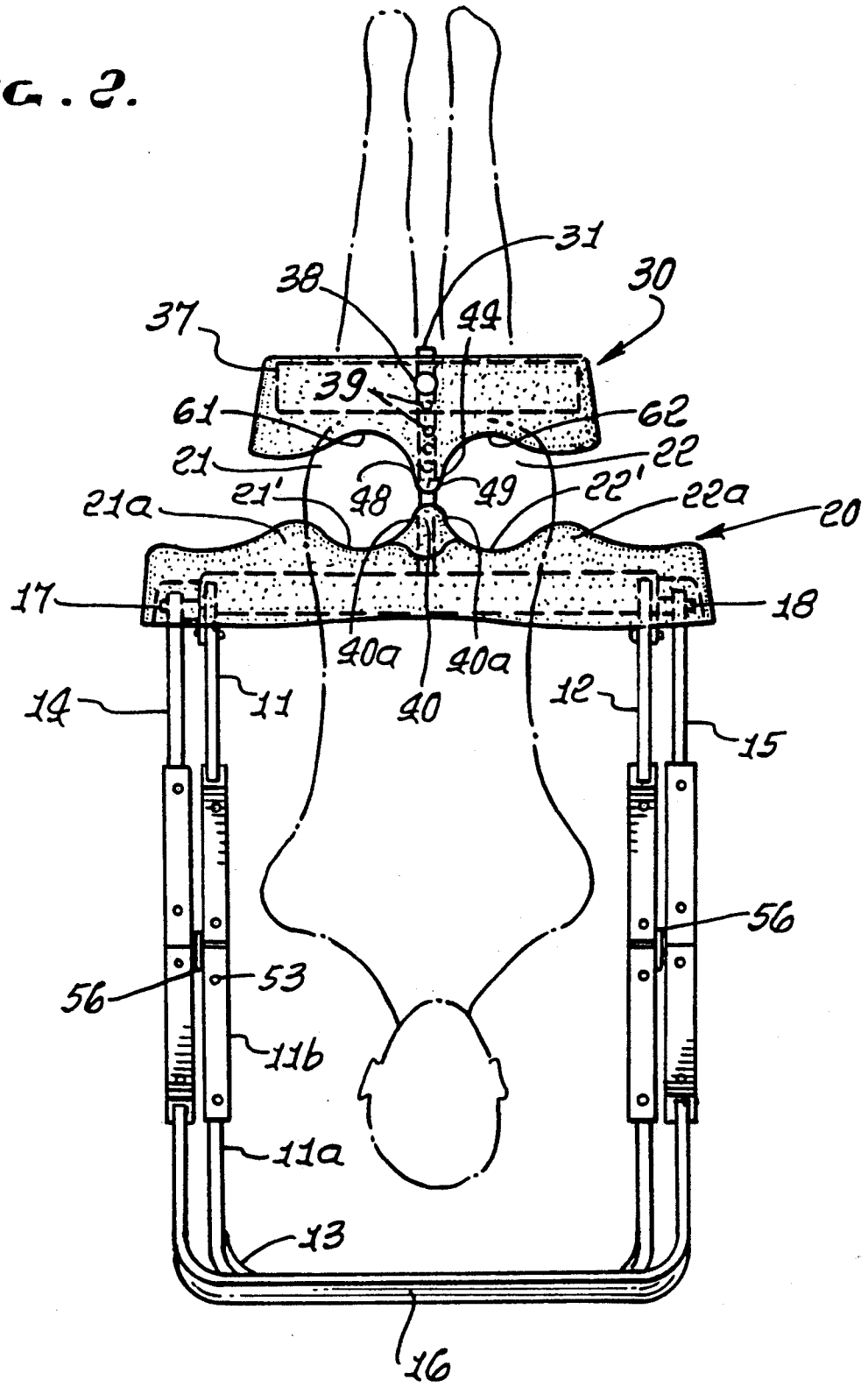
FIG. 2 is an elevation taken on lines 2—2 of FIG. 1.

In FIGS. 1–3, the illustrated exercise apparatus includes a support means 10 in the form of a first pair of leg members 11 and 12 joined by a crossmember 13; and a second pair of leg members 14 and 15 joined by a cross member 16. A pin 17 interconnects the leg members 11 and 14 at their upper ends; and a pin 18 interconnects the leg members 12 and 15 at their upper ends, the two pins 17 and 18 being horizontally coaxial. Accordingly, the pairs of leg members may be spread apart at a selected angle $\alpha$ to provide support for a transverse platform 20 that supports a user's thighs 21 and 22. The platform may also be connected to the leg members as by the pins 17 and 18, whereby the platform is then pivotable about a horizontal axis. Alternatively, the platform may be locked in position, relative to the legs, as shown.

The platform 20 extends transversely, as seen in FIG. 2, to provide thigh support regions 21' and 22' which may be downwardly concave throughout their lengths in a length direction indicated by arrow 24. Also, the platform has a convexly rounded surface 25 which faces horizontally in the direction of arrow 24, to engage and push against the user's body at the juncture of his (or her) trunk 28 and thighs, i.e., the forward pelvic area. Note that the downwardly concave regions 21' and 22' merge with concave regions 21*a* and 22*a* at surface 25, as seen in FIG. 1. This accommodates to the user's thighs when the thighs 21 and 22 and legs extend horizontally, and the trunk 28 extends or hangs downwardly, below platform level.

Figure 1A:
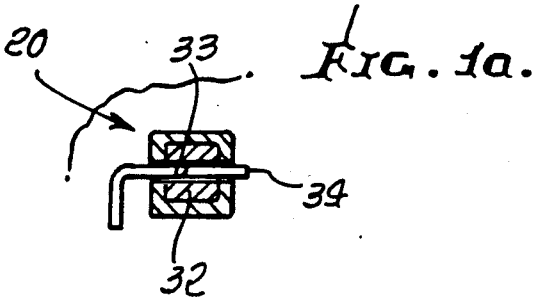

FIGS. 1–3 also show a crosspiece 30 mounted on the support means, as for example via the platform, to extend in spaced relation to the platform upper surface, over the user's leg region supported on the platform. The crosspiece may be carried by a central rigid vertical member 31 which extends downwardly and merges with a rigid horizontal member 32 attached to the platform. That attachment may be horizontally adjustable, as via holes 33 in the platform frame 32, and a pin 34 extending through a selected hole 33 and through a hole in member 32. See FIG. 1*a*. Likewise, vertical positioning of the crosspiece 30 is adjustable as by hole 36 in the crosspiece frame 37, and a pin 38 extending through hole 36 and through a selected hole 39 in member 31. The crosspiece 30 is convexly contoured at 61 and 62, to engage the rear side of the user's legs, as for example proximate the back side of the knee joint at 30*a* and to block upward displacement of the thighs 21 and 22 relative to the platform, to enable trunk swinging and twisting.

In accordance with the invention, other means is provided in association with the platform to induce contraction of the user's thighs relatively toward one another in response to trunk pivoting, for producing anterior rotation of the user's ilium, thereby inducing distraction of the user's sacroiliac joint, at the ilium posterior, relieving pressure on the spine.

Such other means advantageously includes a thigh grippable element 40 projecting into an interthigh region of the user's legs (see FIG. 2), to be gripped or clamped by and between user's thighs as the apparatus user swings his trunk in the position shown in FIG. 1, benefitting the sacroiliac region, as referred to. Element 40 may advantageously comprise a pad integral with the platform and tapering upwardly, as seen in FIG. 2 showing tapered sides 40*a* of the central pad. The user's thighs are induced to grip the pad in use of the apparatus, as seen in FIG. 1. A second pad (or alternate pad) element 44 is seen in FIG. 2, as carried by the crosspiece 30, and projecting downwardly into an inter-thigh region 45 closer to the knee joint. It, too, tapers toward a terminal 47, but in a downward direction, and is adapted to be gripped by and between the user's thighs during use of the apparatus. The platform 20 and pad 40 together define an upwardly facing saddle-like structure; and the pad 44 and crosspiece 30 together define an inverted, saddle-like structure with the concave surface regions 48 and 49 formed by the crosspiece to fit the user's thighs at opposite sides of the pad 44. The two saddles are horizontally offset, as shown, in the direction of arrow 24.

The open spacing of the supporting legs 11 and 12 and of legs 14 and 15 allows the user's head, trunk and arms to hang freely and twist, as during flexing. This helps relieves spinal compression, especially in the sacroiliac region. Hand grips 52 may be provided on the legs 14 and 15, as shown, to project normal thereto. The legs may include telescopically interconnected sections. See for example sections 11*a* and 11*b*, pin connected together as by pins at 53 (see FIG. 2). Also, adjustment means in the form of links 56 may be provided to adjustably interconnect the legs 11 and 13, and the legs 12 and 14, as shown. Links 56 may be pin connected to the legs, as at 58.

Figure 4:
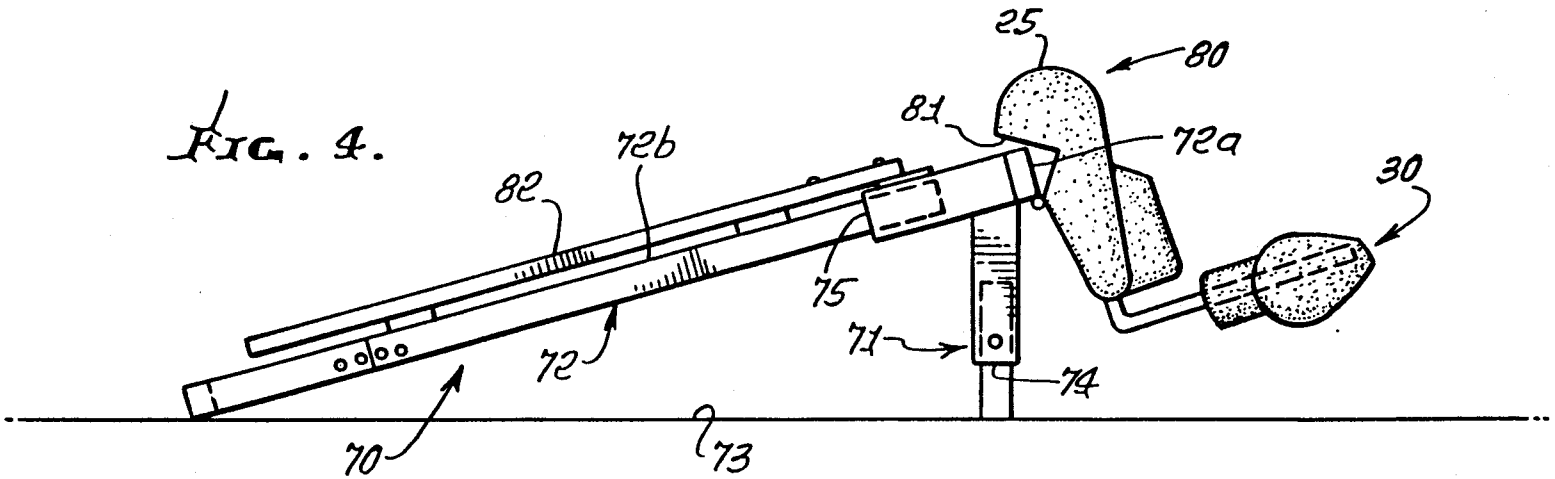
FIG. 4 is a side elevation showing modified apparatus in one position of pivoting.
Figure 5:
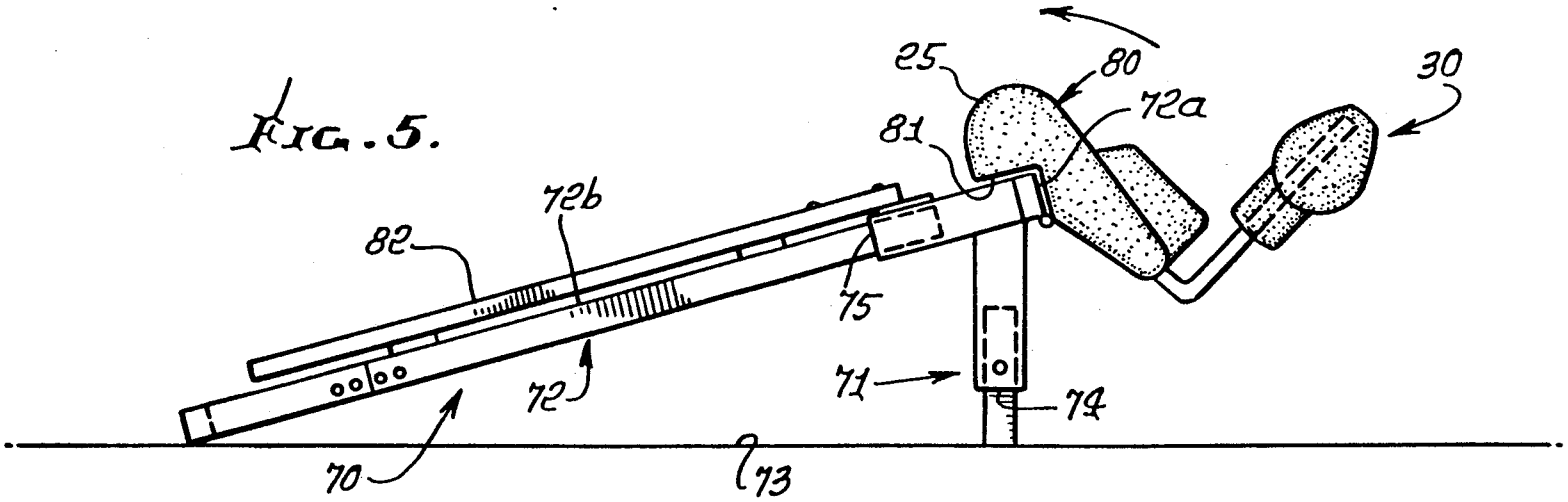
FIG. 5 is a view like FIG. 4 showing the modified apparatus in another pivoted position.

Referring to now to FIGS. 4 and 5, the support means 70 is in the form of a forward leg member or members 71 extending almost vertically, and a rearward leg member 72 extending at less than 45° from horizontal, both resting on a support surface 73. Each leg member or members may be telescopically adjustable, as indicated by structure at 74 and 75.

The platform 80 is generally the same as platform 20, but defines an L-shaped notch 81 at its underside to accommodate the platform to rocking or pivoting between the positions shown in FIGS. 4 and 5. Note that the uppermost end of leg member or members 72, indicated at 72*a*, is received in the notch 81 in FIG. 5 position. The remainder of the structure of the platform 80 and crosspiece 30, and their interconnections and adjustability, are as previously described in FIGS. 1-5.

A backboard 82 is secured to the top 72*b* of the leg members 72, to support the back of an exerciser whose legs and thighs fit over the structure 80 and 30 in a manner as previously described, except that this form of the device also allows the user to lie on his back on the board 82 and extend his legs over the nose or surface 25 at the locations of the rearward sides of his knees. His lower legs may then extend downwardly and between the structures 80 and 30. He may then rock his legs upwardly and downwardly in such position, and also do sit-ups.

Referring now to FIG. 6, the structure is generally the same as shown in FIGS. 1-5, and corresponding numbers are used. Crosspiece 30 has a concave side 30*b* facing in the forward direction, over the platform 20; and the underside of the crosspiece is concave at two locations, 61 and 62, as previously indicated in FIG. 2.

In FIG. 6*a*, the structure is again basically the same as in FIGS. 1-5, but the crosspiece 30 has a modified configuration as shown. The concave extents 61 and 62 of the crosspiece extend over the upwardly concave extents 21' and 22' of the platform 20 near the rearward edges 63 thereof. Also, the legs 11', 12', 14', and 15' are not adjustable in length; and each of the links 56' includes two sections 56*a* and 56*b* which are pivotally interconnected, as a scissors, at 56*c* to allow collapse of legs 11' and 12' towards legs 14' and 15' when desired.

Referring to FIG. 7, the apparatus is again basically the same as in FIGS. 1-5, but the contouring of the platform and crosspiece is modified as shown; and the legs are also modified. The crosspiece 30 extends above the rearward portions of the upwardly concave surfaces of the platform, as in FIG. 6*a*; but the frontwardly facing extent of the crosspiece is upwardly and forwardly concave, as in FIG. 6. The platform 20 is in two sections, namely, a forward concave section 80 attached to a rearward section 81 leaving a concave gap 82 therebetween. The saddle shape of the platform remains. Tubular hand grips 84 are received on the forward legs 14" and 15" as shown. Braces or links 56" extend from intermediate portions of the forward legs 14" and 15" rearwardly and downwardly to connect to lower extents of the rearward legs 11" and 12". Upward ends of the legs 11", 12", 14", and 15" rigidly support the platform.

The modified apparatus of FIG. 8 is generally like that of FIG. 6*b*, as respects the platform and saddle. The support for the platform 20 constitutes a first post 90 rigidly supporting the platform as from its rearward extent, and a second post 91 adjustably interfits the first post telescopically lengthwise. See the adjustment at 92. The second post at its lower end merges with a base 93, as in the form of a continuation of post 91, but configured as shown to project generally horizontally away from the post and beneath the platform 20. See the base tubular lengths 93*a*, 93*b*, 93*c*,, and 93*d*.

In FIGS. 9 and 10, the platform 20 and the crosspiece 30 are generally the same as previously described; however, the crosspiece 30 extends or projects forwardly over a major extent of the platform, as shown. The user's legs or thighs fit endwise reversely between 20 and 30, as in FIG. 9; and a rearwardly facing nose 96 of the crosspiece presses against the user3 s stomach during exercise involving pivoting of both the platform and the crosspiece (carried by the platform) about a horizontal axis as between the solid and broken line positions seen in FIG. 10. For example, pivoting may be through a range between about 90° and 130°. A post 90*a* supports the platform for such pivoting, and a base 97 is connected to the post and extends away from the platform to a second upright post 98 counterbalancing the platform and crosspiece. A downward projection 98*a* from the post 98 may be stabbed into the ground to locate and stabilize this apparatus.

The device of FIGS. 11 and 11*a* is again generally the same as in FIGS. 1-5, the platform and crosspiece being the same as in FIG. 6*a*. A grip bar 110 is added to project below a platform 20 and to have connection with the platform, to be hand gripped by the user, as seen in FIG. 11*a*. This allows the user to pull himself or herself upwardly toward the underside of the platform from the position, as seen in FIG. 1, to thereby even further relieve spinal pressure in the sacroiliac location. Also, the user may extend his or her arms to extend back into FIG. 1 position and controllably twist the trunk, as enabled by left and right hand push or pull on the grip bar or bars.

Also in FIG. 11, the forward legs 100 and 101 of the apparatus extend downwardly in diverging relation to connect to a base 102 having U-shape, as shown, and project beneath the platform. Hand grips 84 on the legs 100 and 101 are like those in FIG. 6*b*.

FIG. 11*b* has platform and crosspiece elements generally as shown in FIG. 6*b*. The two legs 110 and 111 extend downwardly (as in FIG. 11) from the platform, to which they are fixed, and join a base element 112 which does not project rearwardly beneath the platform. Instead, articulated supports 113 and 114, in the form of links, interconnect to the upright legs to a base 115. See the pivot locations 116 and 117 from which the links extend downwardly to base members 115*a* and 115*b*. The latter are part of a U-shaped structure which includes a crosspiece member 116.

In FIG. 12, the platform 120 is generally like that shown in FIG. 6*b* at 20, but is unitary, i.e., the concave portion 80' is integral with the rest of the platform. The crosspiece here is in the form of two straps 130 defining concave openings to receive the user's upper legs, i.e., thighs. Such straps are U-shaped and connected to the platform as at locations 131. A post structure 132 is connected at its upper end to the platform, as via horizontal extent 132*a*, and which may include sections 132*b* and 132*c* for telescopic and adjustable interconnection, as at 134. The section 132*c* is attached at 135 to a horizontal base member 136 projected beneath the platform 120. Lateral members 137 and 138 are connected to the base 136 and project laterally to stabilize the structure. Note the user 140 in a leg or thigh support mode, via the platform and crosspiece and with hanging trunk below platform level enabling twisting as shown to help relieve pressure at the sacroiliac location.

In FIG. 13, support means elements 11 and 15 are substantially the same as in FIG. 1, and are pivotally connected at 18, proximate the apex formed by members 12 and 15. A transverse platform 20 is supported, as for example by a transverse support member 220, carried by top portion of members 12–15. A link 221 is connected at 222 and 223 to the leg members 12 and 15; and a like link may interconnect members 11 and 14 (not shown) as seen in FIG. 2. Grip handles 224 are carried by such links.

A crosspiece is mounted on the support means in offset relative to the platform to deliver therewith a space to receive and pass the user's thigh region, and sized so that the user's legs may fit beneath the crosspiece as his main weight is supported on the platform. See, for example, crosspiece structure 230 which includes a plate 230*a*, and left and right struts 230*b* attached to the plate and extending toward the tops of support members 11, 12, 14, and 15. The struts may be pivotally connected at 18*b* to an axle or axles 18*a* which pivotally support members 11, 12, 14, and 15, as referred to above at 18. The open space 236 between the struts and between plate 230*a* and the platform 20 is adapted to receive and pass the user's legs 237, whereby the lower legs 232*a* extend upwardly beneath plate 230*a*, as shown. Thus, crosspiece 230 pivots about transverse horizontal axis 238, seen in FIG. 13*a*, and relative to platform 20.

Also, auxiliary strut means is provided, as generally indicated at 240, and is connected to the crosspiece and to the support means, to retain or position the crosspiece at a selected angle of tilt or pivoting, as shown, for example. A wide range of tilt angles is selectable, by virtue of the lengthwise adjustability of strut means 240. See, for example, telescopically relatively movably members 240*a* and 240*b*, selectively connectible, as by pins 241 receivable in registered openings 242 and 243 spaced along the members. Member 240*a* is pivotally connected at 244 to the crosspiece structure 230; and member 240*b* is pivotally connected at 245 to the foot 246 of the support means, as at the base of 12.

In FIG. 14, the support means and pad 20 are generally the same as in FIG. 13; and the crosspiece 30 is the same as in FIG. 1, as is its adjustable bracket support 31, providing selective rigid connection to the support means. The leg members 11, 12, 14, and 15 may have construction, as seen in FIG. 14*a*. As seen, member 12 has sub-legs 12*a* and 12*b* end connected, as by interfitting tongue 251 and groove 252 elements, together with two clevis pins 253 received through transverse openings 254 and 255 in the tongue and groove elements. See also retainer pin 257 passed through openings in the clevis pins.

In FIG. 15, like FIG. 13, elongated stretchable means is connected with the support means and manually graspable by a user having his trunk flexed over the platform to yieldably hold his trunk in flexed condition. See, for example, elongated elastomeric band or cable 260 having its lower end connected at 261 to the base 246 of the support means. Two such tensioning bands 260 may be provided to be grasped by the user's two hands 270, or attached to the user's wrists, as shown. The user may then flex back and forth in direction of arrows 271, under rotary tension extended by band 260. Note tilted depression of crosspiece structure 230, to hold the user's legs 280 extended, and tilted downwardly at the right side of the platform 20. Full hamstring stretch is facilitated with force application at the achilles tendon/heel locations, creating greater muscle, ligament and tendon stretch.

FIG. 16 is like FIG. 15 except that plate 230*a* contains an opening to pass the user's lower legs 237*a*, as beneath narrow crosspiece element 230*b* at the back of the knee 237*b*. The user's feet 237*c* extend back over the top of plate 230*a* to thereby firmly lock the user in position as he rotates and flexes under the platform 20.

Exercise associated with FIG. 16 includes gluteus maximum/erector spiral stretch/abdominal entraction. Front ankle entrapment allows for greater quadricep stretch with optimal strap 230*b* across back of knee.

FIG. 17 is like FIG. 13 but shows the manner in which, by exercise flexure of the body, gluteus maximum/erector spinal and extreme spinal extension are achieved.

FIG. 18 shows in greater detail a support apparatus as used in FIGS. 13 and 17.

FIG. 19 shows a greater detail support apparatus as used in FIG. 1.

FIGS. 20 and 20*a* show another use of the apparatus of FIG. 16 with crosspiece 230*a* and strut means 240 in stored position, flexed over center and to the left, under the platform 20. Tension bands 290 and 291 are attached between the user's feet 237*c* and the base at 246, allowing up and down movement of the feet and legs resisted by the bands 290 and 291, without interference by 230 and 240.

In FIG. 21, the apparatus of FIG. 14 is in a second position wherein the frame leg members 11, 12, 14, and 15 are pivoted to extend horizontally on a support surface 258. Note that the user's trunk 259 now can be on that surface 258; his legs 259*a* can fit in the lowered platform 20, as shown; and his feet 259*b* pass through the space between the platform 20 and crosspiece 30 to extend upwardly at the rear side of the crosspiece 30. The elements 20 and 30 thus hold down the user's legs and feet as he performs sit-ups bending his torso back and forth in the direction of arrow 299. Note that positions (15*a* and 14*a*) of the leg members are removed to prevent interference of the user's back with a crosspiece 16 that connects 14*a* and 15*a*. The user's back can thus rest directly on the support surface 258.

FIGS. 22–25 show a modified version of the FIG. 14 apparatus, wherein the support means for the platform 20 comprises two laterally spaced vertical uprights 350 and 351, and an upper lateral member 352 carried by 350 and 351. A hinge 353 has elements 354 and 355 respectively connected to 352 and to the platform underside, as seen in FIG. 23. A lower, lateral member 357 connects the lower ends of uprights 350 and 351, and elongated horizontal support struts connect to 350, 351 and 357. An L-shaped bracket 31 connects the laterally extending pad 30 to the platform 20, as seen in FIG. 23, in the same manner as in FIG. 14. Uprights 350 and 351 may each include lengthwise, height adjustable sections 350*a* and 350*b*, and 351*a* and 351*b*, as seen in FIG. 25, to vary the elevation of parts 20 and 30. Security pins 361 and 362 fit through holes 363 and 364 in the sections 351*a*, 351*b*, and 350*a* and 350*b*, to secure them in lengthwise adjusted positions. Hand holds 365 and 366 are provided on support struts 365*a* and 366*a*. Note the exercise positions of the user in 320 in FIG. 22.

Referring now to FIGS. 26 and 27, the illustrated exercise apparatus includes a support means 410 in the form of a first pair of leg members 411 and 412 joined by a cross-member 413; and a second pair of leg members 414 and 415 joined by a cross member 416. A cross member 417 interconnects the leg members 414 and 415 at their upper ends; and upper ends of the leg members 411 and 412 are pinned at 417' and 418 to upper portions of 414 and 415. Accordingly, the pairs of leg members may be spread apart at a selected angle $\alpha$ to provide support for a transverse platform 420 that supports a user's thighs as in FIG. 2. The platform 420 is rotatably connected to the leg members as by a support sleeve 419 extending about 417, and attached to 420, whereby the platform is then pivotable about a horizontal axis.

The shell-like, molded platform 420 extends transversely, as seen, to provide thigh support regions 421' and 422' which may be downwardly concave in a length direction indicated by arrow 424. Also, the platform has convexly rounded surfaces 425 which face horizontally in the direction of arrow 424, to engage and push against the user's body at the juncture of his (or her) trunk and thighs, i.e., the forward pelvic area. Note that the downwardly concave regions 421' and 422' merge with surfaces 425, as seen in FIG. 27. This accommodates to the user's thighs when the thighs and legs extend horizontally, and the trunk extends or hangs downwardly, below platform level.

FIGS. 26 and 27 also show a crosspiece 430 mounted on the support means, as for example via the "thigh saddle" platform 420, to extend in spaced relation to the platform upper surface, over the user's leg region supported on the platform. The crosspiece may be carried by a central rigid vertical member 431 which extends downwardly and merges with a rigid, generally horizontal extension 430*a* attached to the upperside of the platform. Extension 430*a* is attached, as by welding 430*a'*, to the tubular support sleeve 419, at the center of that sleeve. Member 431 extends upwardly through a central domed portion 440 of the platform, at opening 440*a* therein. Vertical positioning of the crosspiece 430 is adjustable as by pin 438 insertion through selected registered holes 437 and 438' extending laterally through member 431 and through member 432 which directly carries crosspiece 430. Member 432 is adjustably slidable in 431. The crosspiece 430 is cylindrically contoured at padding 461 and 462, to engage the rear side of the user's legs, as for example proximate the back side of the knee joint, and to block upward displacement of the thighs and relative to the platform, to enable trunk swinging and twisting. Crosspiece core 430*c* carries 461 and 462.

In accordance with the invention, other means is provided in association with the platform to induce contraction of the user's thighs relatively toward one another in response to trunk pivoting, for producing anterior rotation of the user's ilium, thereby inducing distraction of the user's sacroiliac joint, at the ilium posterior, relieving pressure on the spine.

Such other means advantageously includes the thigh grippable domed element 440 projecting into an inter-thigh region of the user's legs (see FIG. 27), to be sidewardly gripped or clamped by and between user's thighs as the apparatus user swings his or her trunk, as for example in the position shown in FIG. 1, benefitting the sacroiliac region, as referred to. Element 440 may advantageously comprise a domed pad integral with the platform and tapering upwardly, as seen in FIG. 27, showing tapered lateral sides 440*b* and 440*c* of the central pad. The user's thighs are induced to grip the pad in use of the apparatus, as seen in FIG. 1. A second pad (or alternate pad) element or elements 461 and 462 are seen in FIG. 27, as carried by the cylindrical crosspiece. The platform 420 and pad 440 together define structure formed to fit the user's thighs.

The open spacing between the supporting legs 411 and 412 and between legs 414 and 415 allows the user's head, trunk and arms to hang freely and twist, between such legs, as during flexing. This helps relieves spinal compression, especially in the sacroiliac region. Hand grips 452 may be provided on the legs 414 and 415, as shown, to project normal thereto. The legs may include telescopically interconnected sections, as described above. Also, adjustment means in the form of links 456 may be provided to adjustably interconnect the legs 411 and 414, and the legs 412 and 415, as shown. Links 456 may be pin connected to the legs, as at 458, with the hand grips located on the links, as shown.

Referring now to FIGS. 28–32, the exercise apparatus 501 includes a support means in the form of a first pair of leg members 511 and 512 joined by a lower cross member 513; and a second pair of leg members 514 and 515 joined by a lower cross member 516. An upper cross member 517 is pivotally connected at 517*a* to the upper ends of leg members 511 and 514, and is pivotally connected at 517*b* to the upper ends of leg members 512 and 515, as shown.

Accordingly, the pairs of leg members may be adjustably spread apart, as at an angle $\beta$, to provide support, at selected level, for a transverse platform 520 that supports a user's thighs, as in FIG. 2. The platform extends transversely to provide thigh support regions 521' and 522' (see FIG. 32), which are downwardly concave throughout their lengths in a length direction indicated by arrow 524 in FIG. 29. Also, the platform has a convexly rounded surface 525 which faces horizontally forwardly in the direction of arrow 524, in FIGS. 29–31, to engage and push against the user's body at the junction of his (or her) trunk and thighs, i.e., the forward pelvic area, as referred to in the descriptions of FIGS. 4 and 5. Note that the downwardly concave regions 521' and 522' merge with surface 525.

Thigh grippable element 540 of the platform projects upwardly between 521' and 522' to be gripped or clamped by and between the user's thighs, as the apparatus user swings his (or her) trunk, as described previously in connection with FIGS. 1, 4 and 5. Element 540 may comprise a part of the platform or pad 520, and tapers upwardly, as seen in FIG. 32.

FIGS. 28-32 also show a crosspiece 530 mounted on the support means, as for example via the cross member 517, which carries the platform 520. Crosspiece 530 extends in spaced relation to the platform 520 upper surface, over the user's leg region supported on 520. The crosspiece is shown as carried by a central rigid frame member 531, which extends vertically in FIGS. 29 and 30, and has adjustable attachment with a rigid carrier 532 rigidly attached to the cross member 517. Member 531 is adjustably slidable vertically in means 532, to position it at one of several positions corresponding to registration of laterally extending pin holes 533 in 531 with lateral pin holes 534 in 532. A retention pin may be inserted through the aligned holes to position 531 vertically, thereby positioning crosspiece 530 at selected elevation relative to platform 520, for different user leg sizes.

Note in FIG. 30 that 531 and 530 may be inverted to position 530 below the level of the platform 520, and to be selectively positioned via the pin hole selection referred to. In addition, the carrier 532 accommodates in FIG. 32 a horizontally adjustable positioning of 530 and 531, as via horizontally slidable carriage of 531 by 532, and selected registration of pin holes 533 with horizontally spaced pin holes 534 and 535 in 532. Therefore, both vertical and horizontal selected adjustment of crosspiece 530, relative to platform 520, is provided. This accommodates to different user leg sizes, and a wider range of leg supports and positions for various body swinging and twisting exercises.

Crosspiece 530 is cylindrically contoured at padding 561 and 562, to engage the rear side of the user's legs, as referred to above in the description of FIGS. 26 and 27. See also transverse support 570 for pads 561 and 562, and joined to 531 at 570*a*. Thigh-induced induced gripping of the opposite sides 540*a* and 540*b* of the element 540 is also the same as in FIGS. 26 and 27.

The open spacing between the supporting legs 511 and 512, and between legs 514 and 515 allows the user's head, trunk and arms to hang freely and twist, between the referenced support legs, as during flexing. Hand grips 552 are provided on arms 556 attached to the legs, as shown at 557 and 558. Arms 556 extend generally horizontally above elbows 514' and 515' in legs 514 and 515, whereby arms 556 are shortened. Elbows 514' and 515' strengthen the legs.

FIG. 28 also shows the provision of stop means associated with the support means and with the platform to interrupt pivoting of the platform and crosspiece at a tilted condition of the platform. See in this regard the bar 580 integral with and projecting generally downwardly from the cross member 517, to engage the frame structure 581 attached to legs 514 and 515. This limits tilting of the platform 520 and crosspiece 530, at their positions seen in FIG. 28.

I claim:

1. Exercise apparatus, comprising, in combination:

a) a support means, the user's legs b) a platform mounted on the support means to support a user's legs, there being a hinge connecting the platform to the support means and defining a generally horizontal hinge axis to allow pivoting of the user's trunk about a generally horizontal axis as the user relatively bends his body and his legs means, and extending in spaced c) and other means carried by said platform to induce contraction of the user's thighs relatively toward one another in response to trunk pivoting, for producing anterior rotation of the user's ilium, thereby inducing distraction of the user's sacroiliac joint, at the ilium posterior, the user's legs are substantially encompassed by said pads.

2. The combination of claim 1, including a support medially carrying said crosspiece and extending in an upright plane intersecting said projecting pad element.

3. The combination of claim 1 wherein said platform and said other means together define a saddle.

4. The combination of claim 2, wherein said support means includes a frame having a base and upright means connected to the base.

5. The combination of claim 4 wherein said platform extends generally above the base, and said platform and base have main extents that project generally horizontally away from said upright means.

6. The combination of claim 5 wherein said upright means includes telescopically lengthwise interfitting upper and lower post members, there being holder means holding said members in selected positions of lengthwise interfit, the base and the lower post member comprising a single elongated structure of generally uniform cross section.

7. The combination of claim 4 wherein said upright means comprise a first post supporting said platform, said base projecting generally horizontally away from the post, and there being a second upright post connected to the base in spaced relation to the first post.

8. The combination of claim 4 wherein said upright means includes two upright members which extend downwardly in laterally spaced relation from proximity to the underside of the platform.

9. The combination of claim 8 including a grip bar projecting below the platform and connected thereto, whereby the user's trunk may swing between said two upright members, beneath the platform, and permit hand gripping of the grip bar.

* * * * *

UNITED STATES PATENT AND TRADEMARK OFFICE

CERTIFICATE OF CORRECTION

PATENT NO. : 5,295,936

DATED : March 22, 1994

INVENTOR(S) : Leroy R. Perry, Jr.

It is certified that error appears in the above-identified patent and that said Letters Patent is hereby corrected as shown below:

Column 12, line 9; "a) a support means, the user's legs" should read --a) a support means,--

Column 12, line 16; delete "means and extending in spaced" and insert --,--.

Column 12, lines 22 and 23; delete "the user's legs are substantially encompassed by said pads"

Column 12, after line 23, add to Claim 1 the following:

--d) said other means including a thigh positioning pad forming two spaced, leg-receiving upwardly opening depressions and having an intermediate pad element projecting generally away from said axis between said depressions to extend into an inter-thigh region of the user's legs, to be clamped between the user's thighs, in all positions of rotation of the platform about said axis,

UNITED STATES PATENT AND TRADEMARK OFFICE

CERTIFICATE OF CORRECTION

PATENT NO. : 5,295,936

DATED : March 22, 1994

INVENTOR(S) : Leroy R. Perry, Jr.

It is certified that error appears in the above-indentified patent and that said Letters Patent is hereby corrected as shown below:

e) there being a crosspiece pivotally mounted on the support means and extending in spaced relation to the platform to project over the user's leg regions pivotally supported on the platform, said other means including another pad carried by said crosspiece and having two spaced, downwardly opening depressions to receive the user's legs in linearly offset spaced relation to said upwardly opening depressions, whereby the user's legs are substantially encompassed by said pads.--

Signed and Sealed this

Twenty-fifth Day of October, 1994

*Attest:*

Bruce Lehman

BRUCE LEHMAN

*Attesting Officer*

*Commissioner of Patents and Trademarks*